US006493529B1

(12) United States Patent
Umemura et al.

(10) Patent No.: US 6,493,529 B1
(45) Date of Patent: Dec. 10, 2002

(54) CHARGING DEVICE WITH WALLS SURROUNDING THE ELECTRODES WHICH REDUCE OZONE EMISSIONS

(75) Inventors: Kazuhiko Umemura, Tokyo (JP); Tomoaki Sugawara, Tokyo (JP); Tatsuya Sato, Tokyo (JP); Hiroshi Kondo, Tokyo (JP); Shohji Tanaka, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/609,900

(22) Filed: Jul. 3, 2000

(30) Foreign Application Priority Data

Jul. 5, 1999 (JP) ..... 11-190356
Jul. 12, 1999 (JP) ..... 11-197531

(51) Int. Cl.[7] ..... G03G 15/02; H01T 19/00

(52) U.S. Cl. ..... 399/168; 250/324; 361/225; 361/230; 399/171

(58) Field of Search ..... 399/168, 170, 399/173, 171; 361/222, 225, 230, 212; 250/324, 325, 326; 313/581, 590, 622, 231.41

(56) References Cited

U.S. PATENT DOCUMENTS 4,155,093 A 5/1979 Fotland et al.
4,446,371 A * 5/1984 Cobb ..... 250/324
4,674,857 A * 6/1987 Satomura et al.
4,683,482 A * 7/1987 Inaba et al.
5,408,299 A * 4/1995 Haas
5,521,383 A * 5/1996 Furukawa et al. ..... 250/324
5,666,601 A * 9/1997 Genovese et al. ..... 399/168
5,666,605 A * 9/1997 Tokimatsu et al. ..... 399/173
5,706,162 A * 1/1998 Bergen et al. ..... 361/230
6,084,350 A * 7/2000 Ezaki et al. ..... 313/231.41

FOREIGN PATENT DOCUMENTS

| | | |
|---|---|---|
| JP | 54-053537 | 4/1979 |
| JP | 55-029837 | 3/1980 |
| JP | 56-091253 | 7/1981 |
| JP | 57-169768 | * 10/1982 |
| JP | 60-142367 | * 7/1985 |
| JP | 61-112658 | * 5/1986 |
| JP | 5-094077 | 4/1993 |
| JP | 6-35294 | * 2/1994 |
| JP | 6-075457 | 3/1994 |
| JP | 6-324556 | 11/1994 |
| JP | 7-98533 | * 4/1995 |
| JP | 8-315958 | 11/1996 |
| JP | 9-114192 | 5/1997 |
| JP | 9-115646 | 5/1997 |
| JP | 9-244350 | 9/1997 |
| JP | 11-72990 | * 3/1999 |
| JP | 11-095526 | 4/1999 |

* cited by examiner

*Primary Examiner*—Susan S. Y. Lee
(74) *Attorney, Agent, or Firm*—Oblon, Spivak, McClelland, Maier & Neustadt, P.C.

(57) ABSTRACT

A charging device which charges a body to be charged. At least a pair of linear electrodes is provided on a substrate so as to be close to each other. Walls are provided near the linear electrodes. Each of the walls has a height larger than a line width of each of the linear electrodes. The linear electrodes are surrounded by the walls and the substrate. The charging device alternatively includes a plurality of dielectrics and electrodes disposed along a first direction facing a drum so that the plurality of dielectrics sandwich the plurality of electrodes along a second direction perpendicular to the first direction, the dielectrics have a height larger than a height of the electrodes along the first direction, and at least two neighboring electrodes have different shapes.

39 Claims, 27 Drawing Sheets

FIG.34

| | | OZONE SMELL |
|---|---|---|
| EXAMPLE 1 | | ○ |
| EXAMPLE 2 | SIMILAR TO NINETEENTH EMBODIMENT | ○ |
| EXAMPLE 3 | SIMILAR TO FIFTEENTH EMBODIMENT | ○ |
| EXAMPLE 4 | SIMILAR TO TWENTY-SECOND EMBODIMENT | ○ |
| EXAMPLE 5 | SIMILAR TO TWENTY-FOURTH EMBODIMENT | ○ |
| EXAMPLE 6 | SIMILAR TO TWENTY-FIFTH EMBODIMENT | ○ |
| EXAMPLE 7 | SIMILAR TO TWENTY-SEVENTH EMBODIMENT | ○ |
| EXAMPLE 8 | SIMILAR TO TWENTY-NINTH EMBODIMENT | ○ |
| COMPARISON EXAMPLE 1 | HAVING CONVENTIONAL CORONA WIRE | × |

○ : OZONE DOES NOT SMELL
△ : JUDGEMENT IMPOSSIBLE
× : OZONE SMELLS

CHARGING DEVICE WITH WALLS SURROUNDING THE ELECTRODES WHICH REDUCE OZONE EMISSIONS

FIELD OF THE INVENTION

The present invention relates to a charging device for used in a charger which charges a body such as a photosensitive body, transfer charger, discharger, or the like, and an electrophotographic apparatus such as a copying machine, printer, or facsimile.

BACKGROUND OF THE INVENTION

Charging devices each for use in an image formation apparatus include a corona charging device, a roller charging device, a brush charging device, and a solid charging device. The corona charging device is the most popular one. The corona charging device has, however, a drawback such that it generates a very large amount of ozone. As a counter measure for this drawback, for example, Japanese laid open No. (hereafter referred to as JP-A) 9-114192 discloses a unit which reduces the ozone generating amount. In this unit, a discharge is performed by using a very thin wire of 40 to 50 microns, thereby reducing more than the half of the ozone generating amount.

JP-A-6-324556 discloses a unit in which a metal casing is arranged on three sides of a wire, a metal mesh electrode is arranged near the open side, and ozone generated from the wire is made remain to increase the probability of collision of ozone molecules, thereby reducing the amount of ozone released.

A roller charging device is disclosed in JP-A-56-91253 and is being actively examined in recent years. A brush charging device is disclosed in JP-A-55-29837 and so on. A solid charging device is disclosed in JP-A-54-53537.

JP-A-5-94077 discloses a device in which a number of discharge electrodes are arranged on an insulating member at very small intervals. JP-A-6-75457 discloses a technique where a distance between a charging device and a member on which recording is performed is set to a range of 500 to 3000 $\mu$m so that ion flying distance can be shorten, thereby suppressing diffusion of ozone and to preventing adhesion of toner and the like.

JP-A-9-244350 discloses a discharging device comprising: a discharge electrode on a plate-shaped substrate; a creeping glow discharge unit arranged around the discharge electrode, and a cover which covers the whole discharging device. JPA-9-115646 discloses a method of reducing NOx by using a material of a specific work function as the material of an electrode of a plane solid discharging device.

JP-A-8-315958 discloses a solid discharging device in which a discharge electrode and a counter electrode which extend in parallel to each other on an insulating substrate are formed, a sharp edge-shaped electric field concentration part is formed at the periphery on the side facing the counter electrode of the discharge electrode, and the side facing the discharge electrode of the counter electrode is covered with an insulating film.

JP-A-11-95526 discloses a charging device in which a plurality of discharging units each can independently discharge are formed on a common substrate. Each of the discharging units comprises: a discharge electrode arranged facing a member to be charged which moves relatively, for generating charges applied to the member to be charged; and an ionization range control electrode which is arranged between the member to be charged and the discharge electrode and controls an ionization area of a discharge in an electric field between the charged member and the discharge electrode so as to be between the discharge electrode and the ionization range control electrode.

There is an ozone adsorbent for use in a charging device, which oxidizes generated ozone by a catalyst function such an activated carbon and another ozone absorbent adsorbs ozone on its surface. The social trend in recent years is that the environmental conscious has been being improved. Standards for regulating the generation amount of ozone, such as UL standard, TUV standard, and BAM standard, are set for an image formation apparatus of an electrophotographic system by a plurality of groups many countries and regions.

The corona charging device generates a very large amount of ozone.

In the techniques disclosed in JP-A-9-114192 and JPA-6-324556, the amount of ozone of at most about 50% can be reduced and it is necessary to use an ozone adsorbent or the like.

In the roller charging device, the generation of ozone can be suppressed very much. The device is consequently regarded as a promising one, but the charges on the charged body tend to be uneven. Moreover, toner contamination on the roller surface and vibration due to an AC bias to be applied occurs, and moire or the like often occurs in an image. Further, since it is a rotary member and the roller surface has to be cleaned, the number of members is large. Besides, there are inconveniences such as dielectric breakdown in a photosensitive layer of a photosensitive body as a body to be charged, which causes pin holes, vibration sound, track of a charging roller (plasticizer), permanent deformation of the roller, and the like.

In the brush charging device, stripe charging unevenness, environmental variation, low-temperature streamer discharge, white spot, photosensitive body wear, accumulation of a worn photosensitive body, coming off of a brush, melting of a brush due to abnormal discharge by a damage in the photosensitive member, and the like occur.

Since the ozone adsorber deteriorates with time, it is necessary to replace and maintain an ozone filter.

Although the solid charging device has advantages of its small size and the like, the discharge area is wide and discomfort substances such as ozone and NOx cannot be reduced as much as expected.

SUMMARY OF THE INVENTION

It is an object of the invention to provide a smaller charging device which can reduce ozone and NOx generated and diffused, uniformly charge the surface of a body to be charged, and does not produce a bad image caused by the charging device.

It is another object of the invention to provide a charging device and an electrophotographic apparatus capable of realizing reduced ozone and uniformly charging the body to be charged.

According to one aspect of the invention, at least a pair of linear electrodes is surrounded by walls and the substrate. Therefore, ozone generated and diffused and Nox can be reduced and the size of the device can be reduced.

Further, the longitudinal direction of each of the linear electrodes is in parallel with the axial direction of the charged body. Therefore, the larger amount of charges can be discharged.

Further, the longitudinal direction of each of the linear electrodes may be in parallel with the moving direction of the charged body. Therefore, the construction of an electrode can be also simplified.

Further, a plurality of pairs of the linear electrodes is arranged so that the longitudinal direction of each of the linear electrodes is oblique with respect to the moving direction of the charged body. Therefore, even when paper powders, toner particles and the like on the charged body are partially adhered to an electrode, charging by the electrode is helped by the neighboring electrode.

Further, the substrate may be arranged almost perpendicular to the charged body. Therefore, since the paper powders and toner particles on the charged body are not easily adhered, the charging can be stably controlled.

Further, the wall may be formed so as to extend in the direction except for the direction of the charged body of the line electrode. Therefore, a larger amount of ozone resides in the space sandwiched by the walls and decomposition of ozone is promoted.

Further, the pair of linear electrodes may be arranged so that their electrode faces are opposite to each other. Therefore, a larger amount of ozone resides in the space sandwiched and decomposition of ozone is promoted.

Further, the tips of the linear electrodes may have a saw-tooth shape. Therefore, by concentration of an electric line of force on the tips of the teeth of the electrodes, the efficiency of discharge increases so that charging is performed with a relatively low voltage.

According to another aspect of this invention, a first electrode forms on a first substrate, and a second electrode forms on a second substrate and faces the first electrode over an insulating wall. Discharge occurs by applying an AC voltage across the first and second electrodes. Therefore, generated ions and the like are captured in the space between the substrates and do not escape so that the density of ozone increases.

Further, a bias electrode arranged on the charged body side generates a bias electric field between the bias electrode and the charged body may be also provided. Therefore, the charging amount of the charged body can be arbitrarily controlled. Furthermore, the bias electrode may be integrally formed with the body of the charging device. Therefore, the electrode can efficiently ejects only charges of a necessary polarity among charges generated by the discharge toward the body to be charged.

According to still another aspect of this invention, in a charging device having a space as an ion generating area defined between dielectrics sandwiching electrodes, the neighboring electrodes partially have different shapes. Therefore, the area where the electric field intensity is high is formed, and discharge occurs with a low voltage.

According to still another aspect of this invention, in a charging device having a space as an ion generating part defined between dielectrics sandwiching electrodes, an electrode forms a predetermined angle with a face of each of the dielectrics sandwiching the electrode. Therefore, the area where the electric field intensity is high is formed, and discharge occurs with a low voltage.

Further, in the charging device according to still another aspects of this invention, electrodes which are bilaterally symmetrical may be lined. Therefore, the area where the electric field intensity is high is formed, and discharge occurs with a low voltage.

Further, electrodes of the same shape may be lined. Therefore, with the above structure, the area where the electric field intensity is high is formed, and discharge occurs with a low voltage.

Further, the central part in cross section of the electrode maybe recessed. Therefore, with the above structure, the area where the electric field intensity is high is formed, and discharge occurs with a low voltage.

Further, three or more electrodes may be lined. Therefore, the discharge area becomes wider.

According to still another aspect of this invention, in a charging device having a space as an ion generating area defined between dielectrics sandwiching electrodes, the neighboring electrodes have a step in an ion ejecting direction, three or more electrodes are lined, and an electrode sandwiched by electrodes via dielectrics is recessed in the ion ejecting direction from the electrodes on both sides. Therefore, the area where the electric field intensity is high is formed, and discharge occurs with a low voltage.

Further, neighboring electrodes may have a step in an ion ejecting direction, three or more electrodes may be lined, and an electrode sandwiched by electrodes via dielectrics may be recessed in the ion ejecting direction from the electrodes on both sides. Therefore, the area where the electric field intensity is high is formed, discharge occurs with a low voltage.

Further, neighboring symmetrical electrodes may be paired, each of the pair of electrodes may be sandwiched by dielectrics, and the pair of electrodes may be recessed in the ion ejecting direction from the electrodes on both sides. Therefore, the area where the electric field intensity is high is formed, discharge occurs with a low voltage.

Further, the electrodes on both sides may be closed to the pair of electrodes. Therefore, the area where the electric field intensity is high is formed, discharge occurs with a low voltage.

Further, two or more sets each having the dielectrics, the pair of electrodes, and the electrodes on both sides may be lined. Therefore, the discharge area becomes wider.

Further, a grid electrode may be provided between the ion generating area and the charged body. Therefore, the discharge potential can be certainly obtained.

According to still another aspect of this invention, an electrophotographic apparatus comprises one of the above charging devices. Therefore, an electrophotographic apparatus which produces a small amount of ozone exhaust can be realized without using and ozone filter.

Other objects and features of this invention will become apparent from the following description with reference to the accompanying drawings.

BRIEF DESCRIPTION OF THE DRAWINGS

FIG. 34 is a diagram showing the experiment results of examples 11 to 18 of the invention and the comparison example 1.

DESCRIPTION OF THE PREFERRED EMBODIMENTS

Thirty-one preferred embodiments of the invention will be explained in detail below with reference to the attached drawings.

A charging device of a first embodiment of the invention has: at least a pair of linear electrodes which are arranged close to each other on a substrate; and walls which are provided near the linear electrodes and have a height larger than the line width of the linear electrode, and the linear electrodes are surrounded by at least substrate walls on three sides.

The construction and operation of the charging device of the first embodiment of the invention will be explained below. The charging device of the first embodiment has at least a pair of discharge electrodes on the same plane of a substrate and dielectric walls on the substrate near the discharge electrodes so as to surround the discharge electrodes.

When ions are generated between the discharge electrodes, ozone is generated as an non-preferred generated material. In the charging device of the first embodiment, a large amount of generated ozone is decomposed to oxygen molecules before it is diffused to a remote place from the charging device. When the charging device of the first embodiment is used as a charging device which charges a photosensitive body in an electrophotographic apparatus, the amount of ozone discharged to the ambient environment can be reduced.

Although the reason why a large amount of ozone is decomposed to oxygen in the charging device of the first embodiment is not clear, the inventor of the present invention presumes the reason as follows.

In the charging device of the first embodiment, by providing walls near the electrodes, the diffusing direction of ozone is regulated to one direction. Due to the existence of the walls, the quantity of circumferential air passing through the charging device, more particularly, the electrode surface decreases. From the above, it is presumed that the generated ozone is not diffused so much from the surface of the electrode to the circumference and remains on the inside of the dielectric walls. Therefore, the high density state may be maintained.

Particularly, it is presumed that the highest density state at the time of ozone generation can be maintained by disposing walls each having a sufficient height near the electrodes each having a width of 1 mm or less. The higher the molecule density is, the more ozone is decomposed to oxygen. Consequently, by the time the decomposition is promoted and molecules escape from the opening between the dielectric walls and are diffused to an open space, it can be considered that the ozone density is very low.

Figure 1:
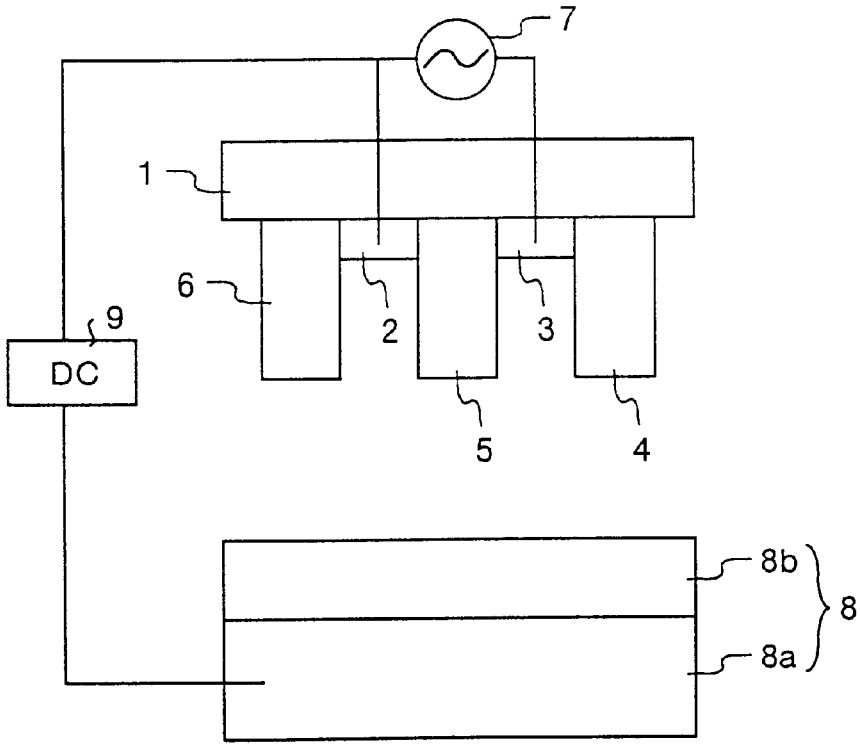
FIG. 1 is a schematic diagram showing a first embodiment of the invention.
Figure 2:
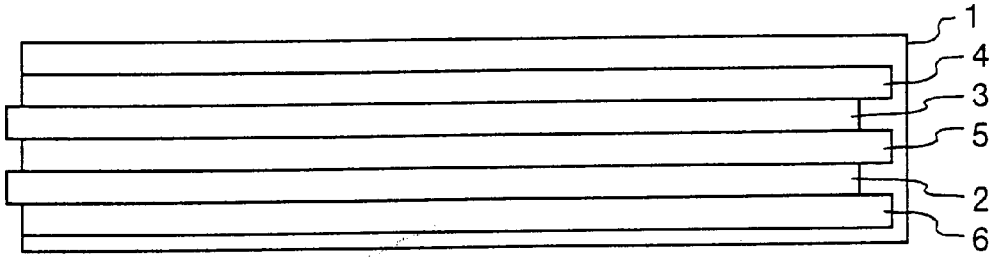
FIG. 2 is a bottom view of the first embodiment.
Figure 3:
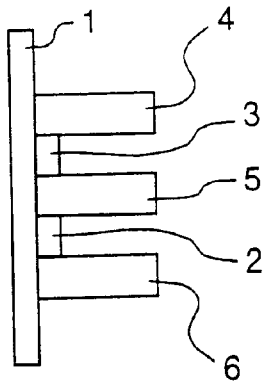
FIG. 3 is a side view of the first embodiment.

FIG. 1 to FIG. 3 show the first embodiment of the invention. The embodiment relates to an electrophotographic apparatus such as copying machine, printer, or facsimile. At least a pair of thin linear discharge electrodes 2 and 3 which face each other and are close to each other are formed on an electrical insulating substrate 1 and insulating walls 4, 5 and 6 made of a dielectric are provided around the electrodes 2 and 3 on the substrate 1.

The discharge electrodes 2 and 3 are linear electrodes. Each of the walls 4, 5 and 6 has a height longer than the line width of each of the electrodes 2 and 3. The electrodes 2 and 3 are surrounded by the walls 4, 5 and 6 and the substrate 1. The electrodes 2 and 3 and the walls 4 to 6 can be formed by properly using known means such as a pattern forming method using a photo-resist and etching, a thin film forming method using sputtering or the like, or a printing method using a thick film paste.

It is preferable that each of the discharge electrodes 2 and 3 has a width of 100 $\mu$m or less and that the distance between the discharge electrodes 2 and 3 is equal to or shorter than 100 $\mu$m. As a material of the discharge electrodes 2 and 3, a metal such as chromium, copper, tungsten, aluminum, titanium, gold, platinum, or indium or a conductive material such as ITO or carbon can be used. The surface of each of the electrodes 2 and 3 may be coated with a thin film made of a metallic oxide.

Although the height of each of the walls 4 to 6 may be similar to that of the discharge electrodes 2 and 3, preferably, it is twice or more as high as that of the discharge electrodes 2 and 3. Each of the walls 4 to 6 is preferably higher than that of each of the discharge electrodes 2 and 3 in a part where the discharge electrodes 2 and 3 face each other. More preferably, each of the walls 4 to 6 is long enough to cover the whole peripheries of the electrodes 2 and 3 used for discharging. When each of the walls 4 to 6 has such a shape, the air on the inside of the walls 4 to 6 is not easily exchanged and generated ozone tends to remain on the inside of the walls 4 to 6. Therefore, the probability of collision of ozone molecules increases, the ozone is easily decomposed, and the amount of ozone exhausted from the charging device is reduced.

An AC power supply 7 is connected between the electrodes 2 and 3 and an AC voltage is applied across the electrodes 2 and 3 from the AC power supply 7. A photosensitive body 8 as a body to be charged is a drum-shaped photosensitive body used in an electrophotographic apparatus. A photosensitive layer 8*b* is deposited on a conductive substrate 8*a*. The photosensitive body 8 is positioned so as to face the charging device of the first embodiment. The photosensitive body 8 is rotated by a not shown driving unit and is moved relative to the charging device of the first embodiment.

The substrate 8*a* of the photosensitive body 8 is connected to the ground, a DC voltage supply 9 is connected between the substrate 8*a* of the photosensitive body 8 and the electrode 2 and a DC voltage is applied between the substrate 8*a* of the photosensitive body 8 and the electrode 2 from the DC voltage supply 9, thereby obtaining a potential difference between the substrate 8*a* of the photosensitive body 8 and the electrode 2. In the charging device of the first embodiment, an AC voltage is applied across the electrodes 2 and 3 from the AC power supply 7. A discharge occurs in the wall 5 made of a dielectric positioned between the electrodes 2 and 3, and the surface of the photosensitive body 8 is charged with ions generated by the discharge.

The first embodiment relates to the charging device which charges the photosensitive body 8 as a body to be charged, comprising at least the pair of linear electrodes 2 and 3 provided close to each other on the substrate 1 and the walls 4 to 6 which are provided near the linear electrodes 2 and 3 have a height larger than the line width of each of the linear electrodes 2 and 3. Since the linear electrodes 2 and 3 are surrounded by the walls 4 to 6 and the substrate 1, generated and diffused ozone and NOx can be reduced and the size of the device can be reduced. Therefore, the surface of the charged body can be uniformly charged, and a bad image due to the charging device can be prevented.

Embodiments of the invention will now be described. The embodiments were carried out according to the first embodiment under conditions that the electrodes 2 and 3 are made of aluminum, the width of each of the electrodes 2 and 3 is set to 50 $\mu$m, the walls 4 to 6 are made of Teflon, the width of each of the walls 4 to 6 is set to 50 $\mu$m, and the height of each of the walls 4 to 6 is set to 100 $\mu$m.

Figure 4:
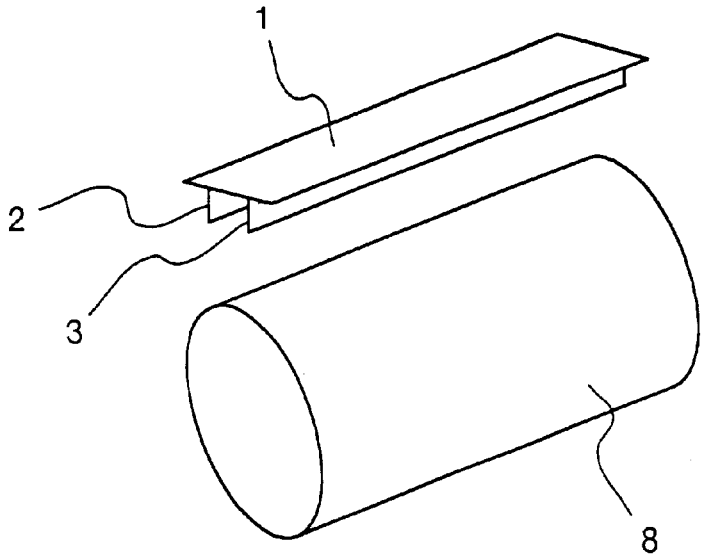
FIG. 4 is a schematic view showing a second embodiment of the invention.

FIG. 4 schematically shows a second embodiment of the invention. In the charging device of the second embodiment, the linear electrodes 2 and 3 of the first embodiment are arranged to become long for the direction of the axis of the exposure body 8, in other words, the longitudinal direction of each of the linear electrodes 2 and 3 and the walls 4 to 6 is arranged parallel to the axial direction of the photosensitive body 8. Thus, the charging device of second embodiment has a long discharge area for the photosensitive member 8. Therefore, a larger amount of charges is discharged and the charging of the photosensitive body 8 can be highly, stably controlled. In FIG. 4, the walls 4 to 6 are omitted.

Figure 5:
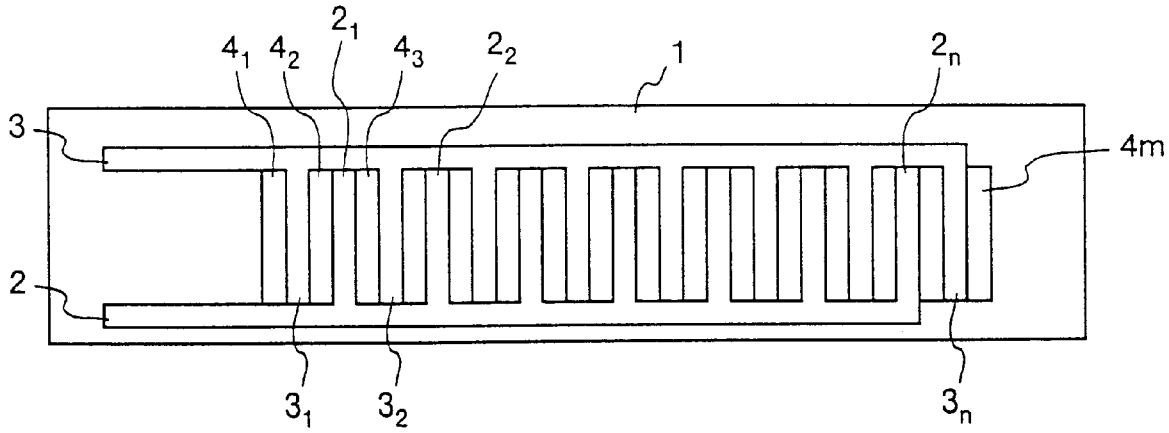
FIG. 5 is a bottom view showing a third embodiment of the invention.
Figure 6:
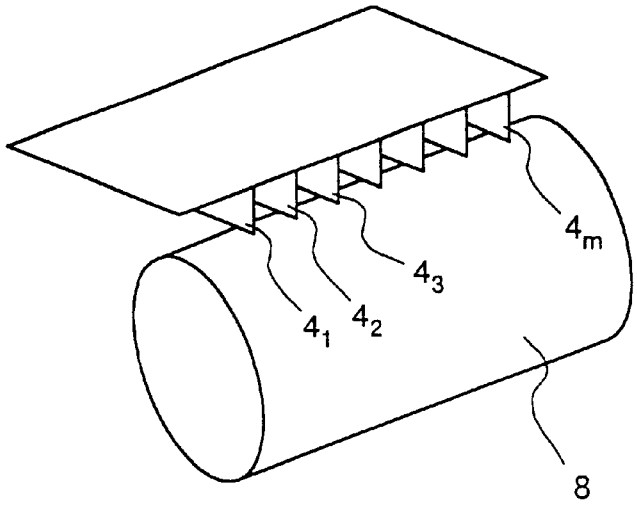
FIG. 6 is a schematic view of the third embodiment.

FIG. 5 and FIG. 6 show a third embodiment of the invention. In the charging device of the third embodiment, the linear electrodes 2 and 3 of the first embodiment are arranged to become long for the direction of travel of the photosensitive body 8, in other words, the longitudinal direction of each of the linear electrodes 2 and 3 and walls $\mathbf{4}_1$ to $\mathbf{4}_m$ is parallel to the travel direction of the photosensitive body 8. The linear electrodes 2 and 3 and the walls $\mathbf{4}_1$ to $\mathbf{4}_m$ are arranged in the configuration that a plurality of pairs of $\mathbf{2}_1, \mathbf{2}_2, \mathbf{2}_3, \ldots \mathbf{2}_n$ and $\mathbf{3}_1, \mathbf{3}_2, \mathbf{3}_3, \ldots \mathbf{3}_n$ and the plurality of walls $\mathbf{4}_1$ to $\mathbf{4}_m$ are arranged along the axial direction of the photosensitive body 8.

In the third embodiment, since the longitudinal direction of each of the linear electrodes 2 and 3 is parallel to the travel direction of the photosensitive body 8, the construction of the electrodes can be simplified. Since the linear electrodes 2 and 3 are formed so that the plurality of linear electrodes $\mathbf{2}_1, \mathbf{2}_2, \mathbf{2}_3, \ldots \mathbf{2}_n$ and $\mathbf{3}_1, \mathbf{3}_2, \mathbf{3}_3, \ldots \mathbf{3}_n$ are arranged in the axial direction of the photosensitive body 8, fine adjustment such as a control of application of a voltage to each of the electrodes $\mathbf{2}_1, \mathbf{2}_2, \mathbf{2}_3, \ldots \mathbf{2}_n$ and $\mathbf{3}_1, \mathbf{3}_2, \mathbf{3}_3, \ldots \mathbf{3}_n$ can be easily performed. Even if a failure such as a breakdown of any of the electrodes $\mathbf{2}_1, \mathbf{2}_2, \mathbf{2}_3, \ldots \mathbf{2}_n$ and $\mathbf{3}_1, \mathbf{3}_2, \mathbf{3}_3, \ldots \mathbf{3}_n$ occurs, a discharge can be maintained by the rest of the electrodes.

Figure 7A:
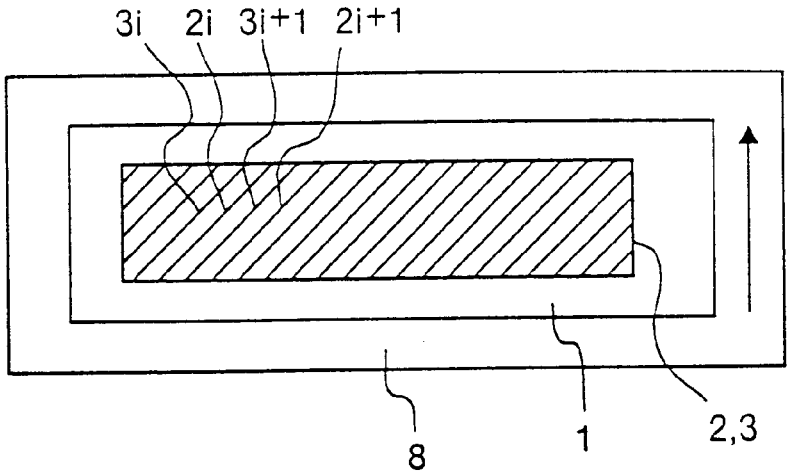
FIG. 7A is a front view and FIG. 7B is a side view of the fourth embodiment.
Figure 7B:
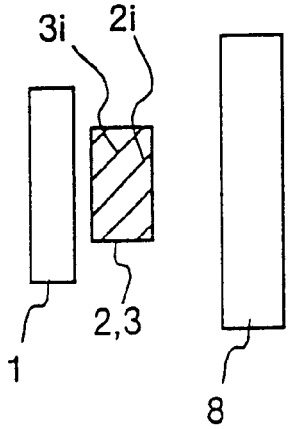

FIG. 7 shows a fourth embodiment of the invention. The fourth embodiment is a charging device according to the third embodiment, in which the electrodes $\mathbf{2}_1, \mathbf{2}_2, \mathbf{2}_3, \ldots \mathbf{2}_n$ and $\mathbf{3}_1, \mathbf{3}_2, \mathbf{3}_3, \ldots \mathbf{3}_n$ are arranged oblique with respect to the axial direction of the photosensitive body 8. In the fourth embodiment, even when paper powders and toner particles on the photosensitive body 8 are partially adhered to one of the electrodes, charging by the electrode is helped by the neighboring electrode. Therefore, occurrence of charging unevenness is suppressed.

Figure 8:
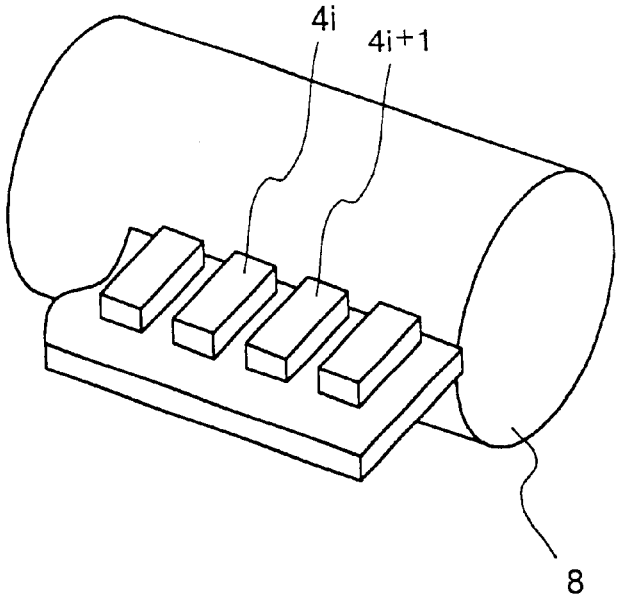
FIG. 8 is a schematic view showing a part of a fifth embodiment of the invention.

FIG. 8 shows a fifth embodiment of the invention. The fifth embodiment is a charging device according to the third embodiment, in which the longitudinal direction of each of the substrate 1, plurality of linear electrodes $\mathbf{2}_1, \mathbf{2}_2, \mathbf{2}_3, \ldots \mathbf{2}_n$ and $\mathbf{3}_1, \mathbf{3}_2, \mathbf{3}_3, \ldots \mathbf{3}_n$ and the plurality of walls $\mathbf{4}_1$ to $\mathbf{4}_m$ is almost perpendicular to the photosensitive body 8. In the charging device of the fifth embodiment, paper powders and toner particles on the photosensitive body 8 are not so adhered and the charging can be stably controlled. Since a path of an air current is assured in the vertical direction, it facilitates descent of relatively heavy ozone molecules and exchange of oxygen, and the discharge is stabilized. In FIG. 8 to FIG. 10 and FIG. 12 to FIG. 14, the linear electrodes are omitted.

Figure 9:
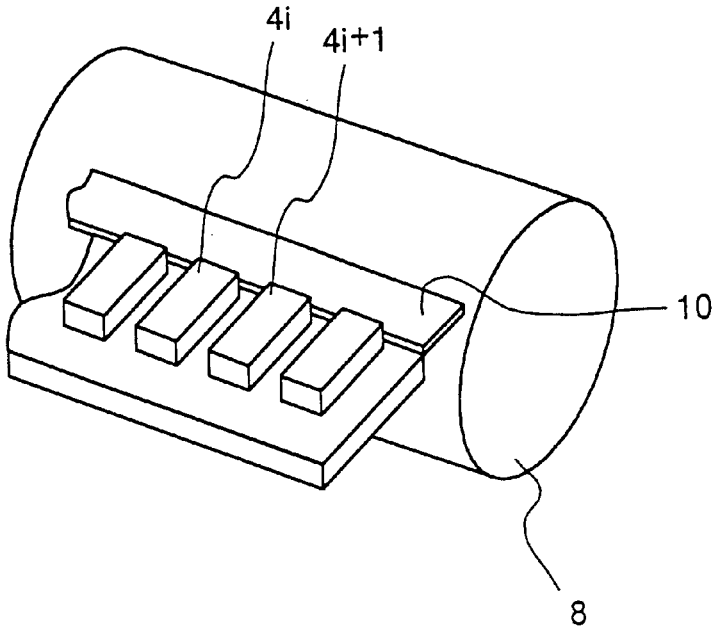
FIG. 9 is a schematic view showing a part of a sixth embodiment of the invention.

FIG. 9 shows a sixth embodiment of the invention. The sixth embodiment is a charging device according to the fifth embodiment, in which an insulating plate 10 is arranged as a cover in parallel to the substrate 1. The plate 10 is interposed between the substrate 1 and the photosensitive body 8 to prevent diffusion of ozone particles. Therefore, ozone stays easily between the neighboring walls $\mathbf{4}_1$ to $\mathbf{4}_m$ and decomposition of ozone is promoted.

Figure 10:
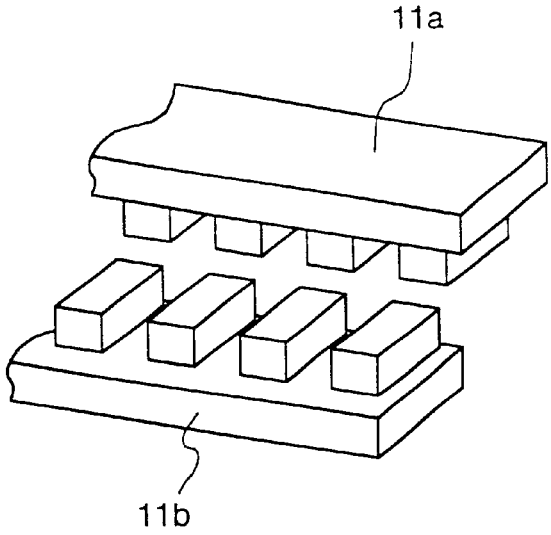
FIG. 10 is a schematic view showing a part of a seventh embodiment of the invention.

FIG. 10 shows a seventh embodiment of the invention. In the seventh embodiment, two charging devices 11*a* and 11*b* each similar to that of the fifth embodiment are arranged so that their electrodes face each other, thereby preventing the diffusion of ozone molecules. Therefore, ozone stays easily between the walls of the two charging devices 11*a* and 11*b* and the decomposition of ozone is promoted.

Figure 11:
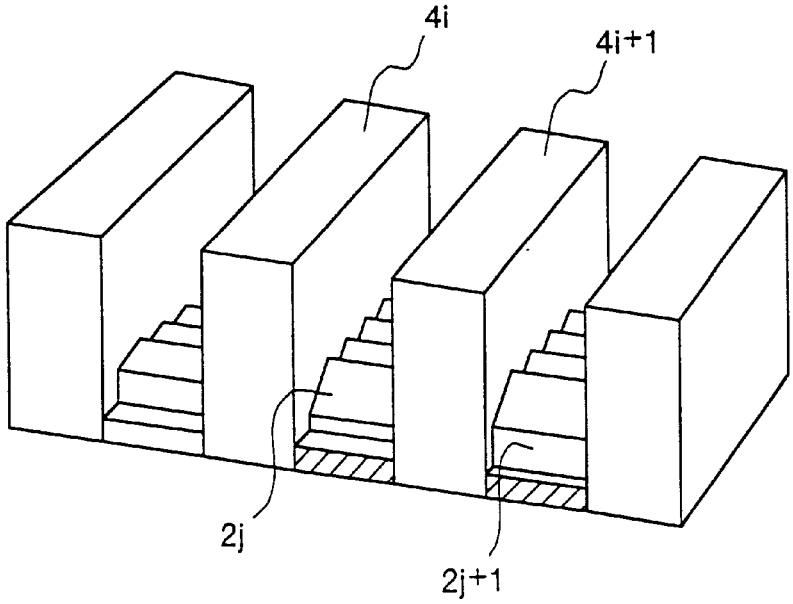
FIG. 11 is a schematic view showing a part of an eighth embodiment of the invention.

FIG. 11 shows a eighth embodiment of the invention. The eighth embodiment is a charging device according to the fifth embodiment, in which the surfaces (faces opposite to the photosensitive body 8) of the electrodes $\mathbf{2}_1, \mathbf{2}_2, \mathbf{2}_3, \ldots \mathbf{2}_n$ and $\mathbf{3}_1, \mathbf{3}_2, \mathbf{3}_3, \ldots \mathbf{3}_n$ are formed in a saw-tooth shape. The pitch of the teeth of the electrodes $\mathbf{2}_1, \mathbf{2}_2, \mathbf{2}_3, \ldots \mathbf{2}_n$ and $\mathbf{3}_1, \mathbf{3}_2, \mathbf{3}_3, \ldots \mathbf{3}_n$ is set to 100 $\mu$m and the height of each tooth is set to 20 $\mu$m. In the charging device of the eighth embodiment, the efficiency of discharge is increased by concentrating the electric line of force on the tip of each tooth of the electrode. Therefore, the charge can be performed with a relatively low voltage.

Figure 12:
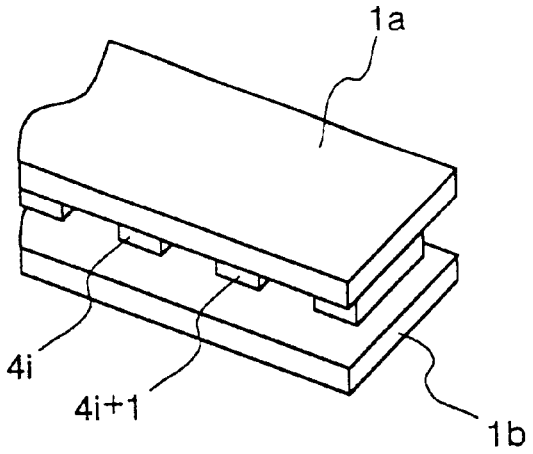
FIG. 12 is a schematic view showing a part of a ninth embodiment of the invention.

FIG. 12 shows an ninth embodiment of the invention. The ninth embodiment is a charging device, in which comb-shaped thin linear electrodes 2 and 3 are formed on each of substrates 1*a* and 1*b* and are adhered to each other via the walls $\mathbf{4}_1$ to $\mathbf{4}_m$ made of a dielectric. The AC power supply 7 is connected between the electrodes 2 and 3 and a DC voltage is applied across the electrode 2 and the substrate 8*a* of the photosensitive body 8 from the DC voltage source 9. The insulating walls $\mathbf{4}_1$ to $\mathbf{4}_m$ are provided around the electrodes 2 and 3 on the substrates 1*a* and 1*b*, and the electrodes 2 and 3 are surrounded by the walls $\mathbf{4}_1$ to $\mathbf{4}_m$ and the substrate 1.

An AC voltage is applied across the electrodes 2 and 3 from the AC power supply 7, a discharge occurs, and the photosensitive body 8 is charged with ions generated by the discharge. In the charging device of the ninth embodiment, a discharge occurs between the two electrodes 2 and 3 and the ions generated at that time and the like are captured between the substrates 1*a* and 1*b* and can escape only in the vertical direction. Thus, the density of ozone consequently increases. Therefore, decomposition of ozone is promoted, and the density of ozone exhausted is decreased.

Figure 13:
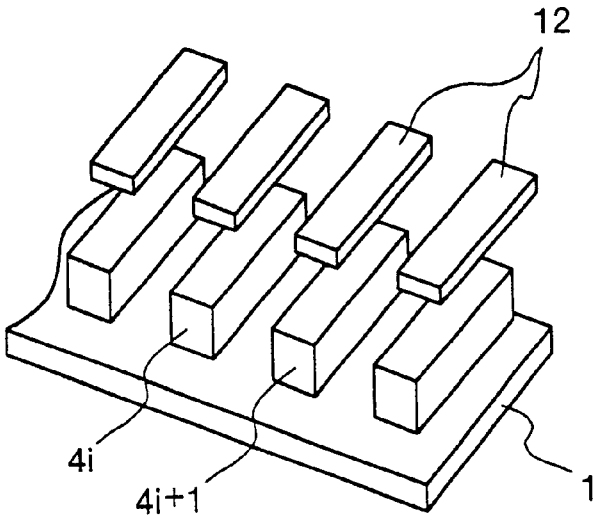
FIG. 13 is a schematic view showing a part of a tenth embodiment of the invention.

FIG. 13 shows a tenth embodiment of the invention. In the tenth embodiment, a lattice electrode 12 is provided in a place between the charging device of the tenth embodiment and the photosensitive body 8, apart from the walls $\mathbf{4}_1$ to $\mathbf{4}_m$ only by 4 mm. The lattice electrode 12 is a comb shaped electrode made of aluminum. The thickness is 100 $\mu$m and the interval is 100 $\mu$m. In the charging device of Embodiment 9, the charging amount of the photosensitive body 8 can be arbitrarily controlled. A DC bias voltage from a not shown bias power source is applied to the lattice electrode 12 and only charges of a necessary polarity among the charges generated by the discharge are efficiently extracted toward the photosensitive body 8.

Figure 14:
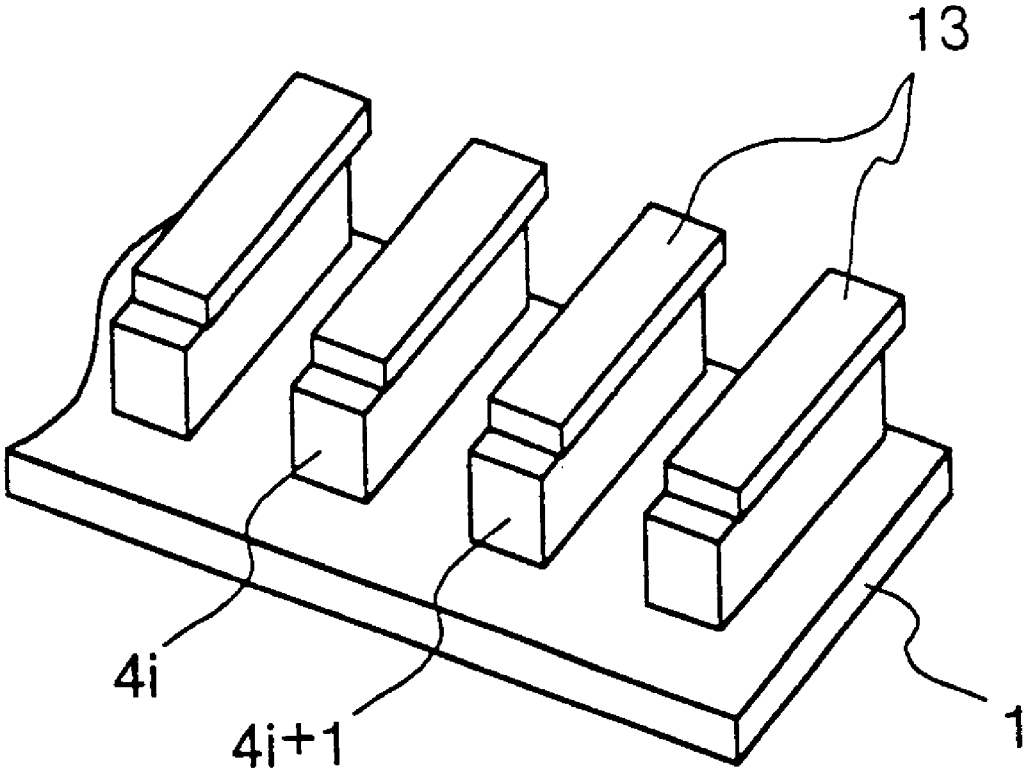
FIG. 14 is a schematic view showing a part of an eleventh embodiment of the invention.

FIG. 14 shows a eleventh embodiment of the invention. In the eleventh embodiment, the charging device of the third embodiment is used as a charging device body, and linear electrodes 13 are arranged on the walls $\mathbf{4}_1$ to $\mathbf{4}_m$ between the charging device body and the photosensitive body 8. A DC bias voltage is applied from a not shown bias supply to the linear electrode 13 and charges of only a necessary polarity among the charges generated by the discharge are efficiently extracted toward the photosensitive body 8. By forming the linear electrodes 13 integrally with the charging device body, handling and especially maintenance at the time of cleaning are facilitated.

The lattice electrode 12 or linear electrodes 13 may be also provided in each of the first embodiment and the second and ninth embodiments in a manner similar to the tenth and eleventh embodiments.

In a laser printer, images were formed by using the charging devices of the second to eleventh embodiments each as a charging device which charges the photosensitive body. The laser printer is NX-100 made by RICOH COMPANY, LTD. having a printing speed of 13 sheets per minute and NX-900 made by RICOH COMPANY, LTD. having a printing speed of 45 sheets per minute. NX-100 and NX-900 made by Ricoh Co., Ltd. are of a corona charging method in which a charging device which charges the photosensitive body uses a wire. When images were formed by NX-100 and NX-900, the room smelled ozone after a few hours. When images were formed by using the charging devices of the second to eleventh embodiments each as a charging device which charges the photosensitive body, the ozone smells were hardly felt. The obtained images were good without charging unevenness or the like.

A charging device of a twelfth embodiment of the invention comprises at least a pair of discharge electrodes on the same plane of a substrate and walls of a dielectric on the substrate near the discharge electrodes so as to surround the discharge electrodes. In the charging device of the twelfth embodiment, a large amount of generated ozone is decomposed to oxygen molecules before the ozone is diffused far from the charging device. Therefore, the amount of ozone released to the peripheral environment can be reduced.

In the charging device of the twelfth embodiment, although the reason why a large amount of ozone is decomposed to oxygen is not clear, the inventor of the present invention presumes the reason as follows. By providing walls near the electrodes, the diffusing direction of ozone is regulated to one direction (ozone generating direction). Due to the existence of the walls, the quantity of circumferential air passing through the charging device, more particularly, the electrode surface decreases. From the above, it is presumed that the generated ozone is not diffused so much from the surface of the electrode to the circumference and remains on the inside of the dielectric walls. Therefore, the high density state is maintained more.

The higher the density of molecules of ozone is, the more ozone is decomposed to oxygen. By the time the decomposition is promoted and molecules escape from the opening between the dielectric walls and diffused to an open space, it can be considered that the ozone density is very low. A main construction of the twelfth embodiment is that discharge electrodes and dielectrics are stacked, a power supply which discharges and a bias supply are connected to the discharge electrode to generate a discharge, and a member to be charged is charged. The dielectric prevents diffusion of ozone generated by insulation and discharge between the electrodes.

In a charging device of the twelfth embodiment, a pair of thin discharge electrodes is formed on an electrical insulating substrate and insulating walls are provided around the discharge electrodes. The charging device can be formed not only by adhering the electrodes and dielectrics but also by properly using known means such as a pattern formation using a photo-resist and etching or a thin film formation using sputtering or the like. As a material of the electrodes, a metal such as chromium, copper, tungsten, aluminum, titanium, gold, platinum, or indium or a conductive material such as ITO or carbon can be used.

An appropriate thickness of the electrode ranges from 10 $\mu$m to a few mm. When the thickness of the electrode is smaller than that, a high-precision fabricating process is necessary, the reliability of the device deteriorates, and fabricating costs increase. As the power source for discharge, a power source which generates an alternate current, a direct current, or a mixture of them is used. The bias supply generally supplies a direct current. The polarity of connection is determined according to the polarity at the time of charging the member to be charged.

According to an thirteenth embodiment of the invention, a charging device using a space defined by dielectrics and electrodes sandwiched by the dielectrics as an ion generating area has a section in which the neighboring electrodes have shapes different from each other. In the embodiment, as compared with the discharge by a conventional corona wire and a discharge by a charging device in which electrodes of the same shape are lined, a section having a high electric field intensity is formed. Therefore, a discharge occurs with a low voltage, and the ozone generation amount can be reduced.

According to a fourteenth embodiment of the invention, a charging device using a space defined by dielectrics and electrodes sandwiched by the dielectrics as an ion generating area has an electrode which forms a predetermined angle with each of the faces of the dielectrics sandwiching the electrode.

In this embodiment, as compared with a charging device in which electrode does not form a predetermined angle with each of the faces of the dielectrics sandwiching the electrode, a section of a high electric field intensity is formed. Therefore, a discharge occurs with a low voltage, and the ozone generation amount can be reduced.

The predetermined angle denotes an angle at which the dielectric face and the electrode face are not perpendicular to each other among the angles formed by the dielectric face and the electrode face. An appropriate predetermined angle is, for embodiment, in a range from 10 to 80 degrees or a range from 170 to 100 degrees.

Figure 15:
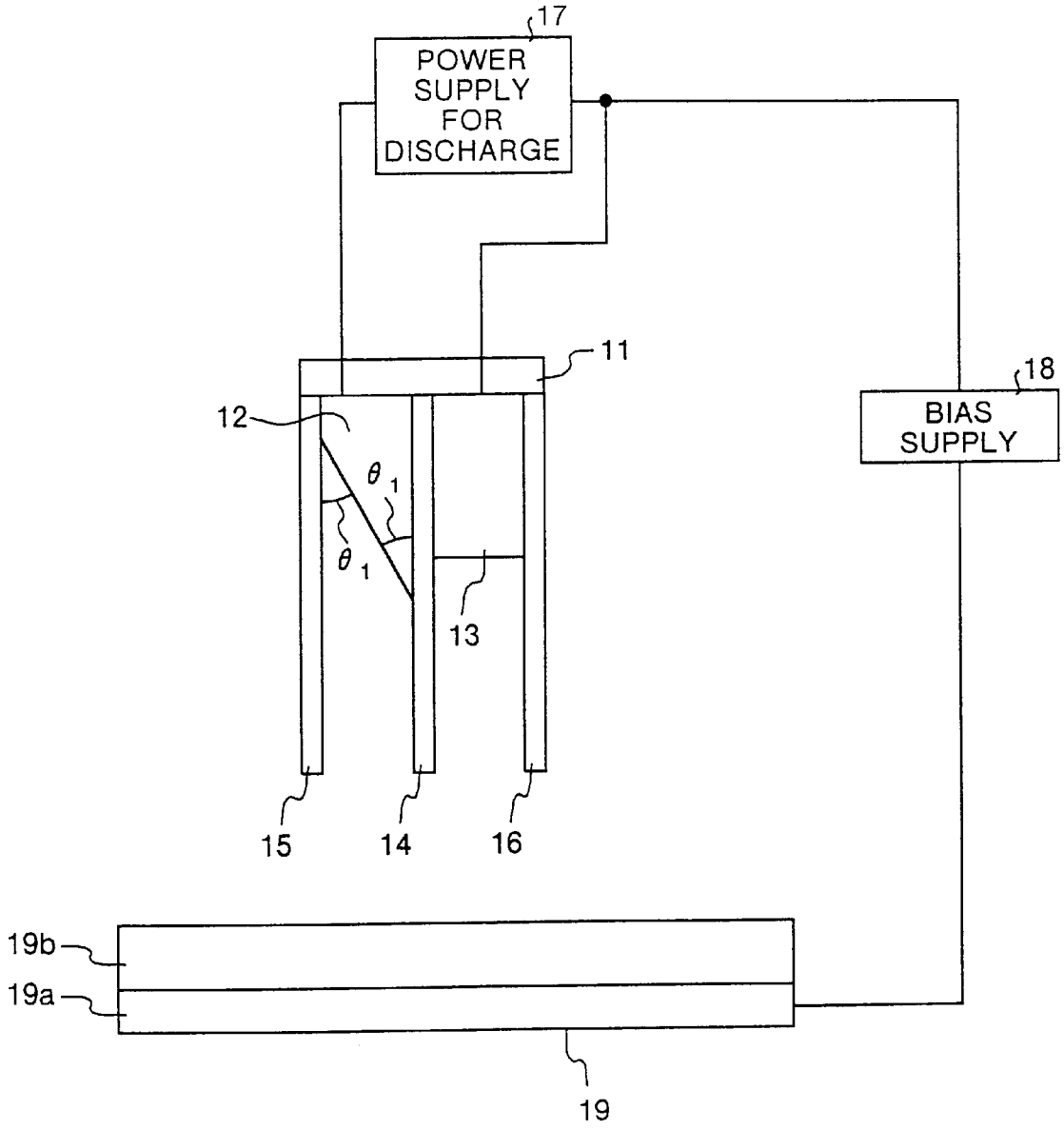
FIG. 15 is a cross section of a fifteenth embodiment of the invention.

FIG. 15 shows the fifteenth embodiment of the invention. In the fifteenth embodiment, a pair of discharge electrodes 12 and 13 is provided on the same plane of an electrical insulating substrate 11. A dielectric wall 14 to 16 is provided between the electrodes 12 and 13 on the substrate 11 and outside of the electrodes 12 and 13 so as to sandwich the electrodes 12 and 13 and form a roughly closed space around the electrodes 12 and 13. The roughly closed space formed by the dielectric walls 14 to 16 and the electrodes 12 and 13 sandwiched by the dielectric walls 14 to 16 are ion generating areas.

The shapes of the electrodes 12 and 13 are different from each other. For example, the electrode 12 has a shape whose face on the ion generating area is oblique with respect to the substrate 11. The electrode 13 has a shape whose face on the ion generating area side is parallel to the substrate 11. The angle $\theta_1$ formed between the face on the ion generating area side of the electrode 12 and each of the walls 14 and 15 is the predetermined angle which is appropriate in a range from 10 to 80 degrees.

As the power source 17 for discharge, an AC power source or DC power source is used or both the AC and DC power sources are used. The power source 17 for discharge is connected between the electrodes 12 and 13. An AC voltage, a DC voltage, or a voltage obtained by mixing the AC and DC voltages are applied across the electrodes 12 and 13. The bias supply 18 is connected to members to be charged such as a conductive substrate 19*a* of a photosensitive body 19 in an electrophotographic apparatus and one (13) of the electrodes 12 and 13. The bias supply 18 applies a DC bias voltage between the conductive substrate 19*a* of the photosensitive body 19 and the electrode 13.

The photosensitive body 19 has the photosensitive layer 19*b* on the conductive substrate 19*a*. In the charging device of the second embodiment, the ion generating areas which are spaces defined by the walls 14 to 16 and the electrodes 12 and 13 which are sandwiched by the walls 14 to 16 are opened to the photosensitive body 19. When the voltage for discharge is applied across the electrodes 12 and 13 from the power source 17 for discharge, a discharge occurs between the electrodes 12 and 13. Ions generated by the discharge are emitted to the photosensitive body 19 from the ion generating areas which are spaces formed by the walls 14 to 16 and the electrodes 12 and 13 sandwiched by the walls 14 to 16, and the photosensitive layer 19*b* of the photosensitive member 19 is charged.

Figure 16:
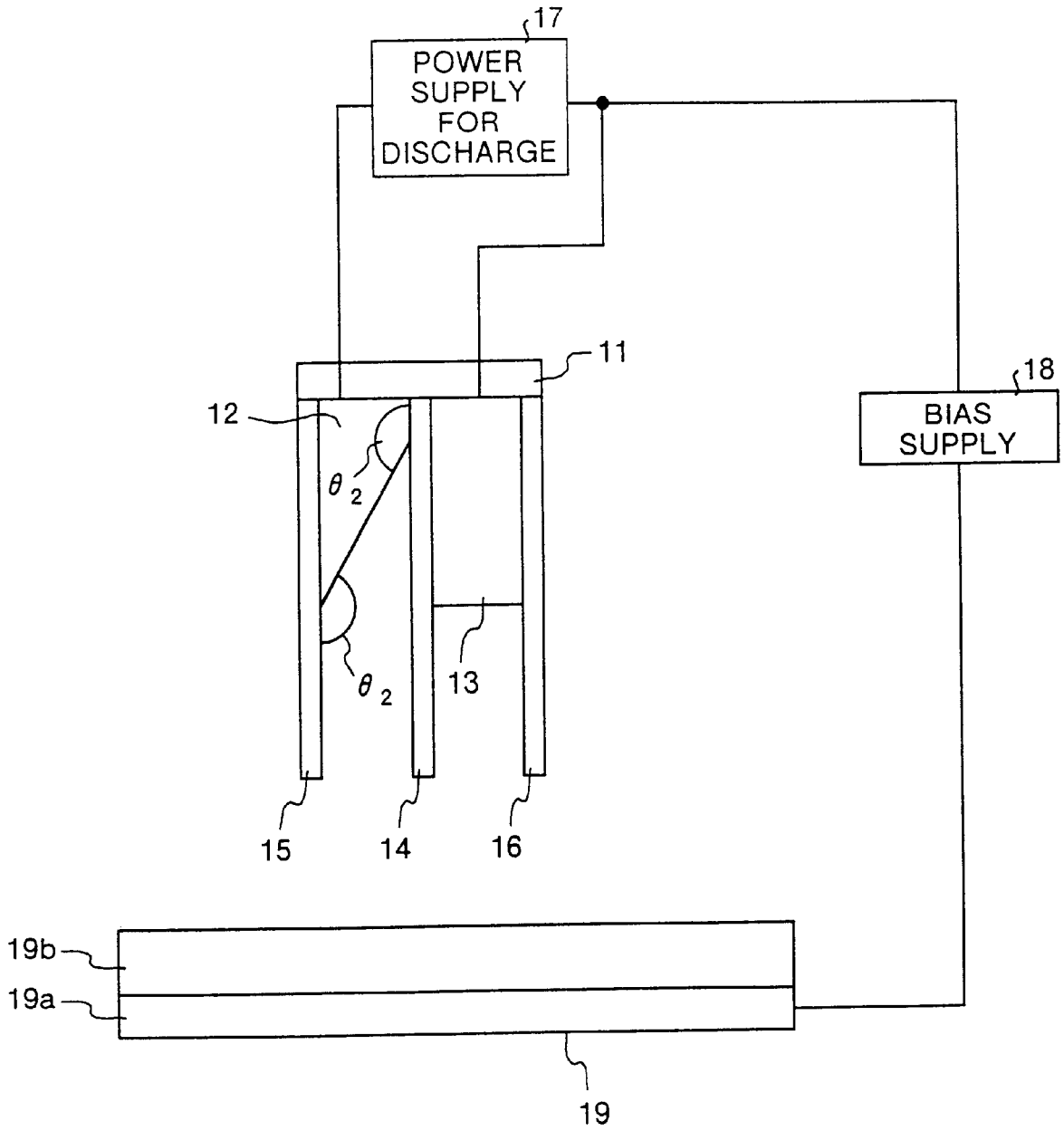
FIG. 16 is a cross section of a sixteenth embodiment of the invention.

FIG. 16 is the sixteenth embodiment of the invention. The sixteenth embodiment is similar to the fifteenth embodiment except that the inclined angle of the face on the ion generating area side of the electrode 12 is changed so that the angle $\theta_2$ formed between the face on the ion generating area side of the electrode 12 and each of the walls 14 and 15 ranges from 170 to 100 degrees.

A seventeenth embodiment of the invention is a charging device according to the fifteenth embodiment, in which electrodes which are bilaterally symmetrical are lined. Thus, a section having high electric field intensity is formed. Therefore, a discharge occurs with a low voltage, and an ozone generating amount can be reduced.

Figure 17:
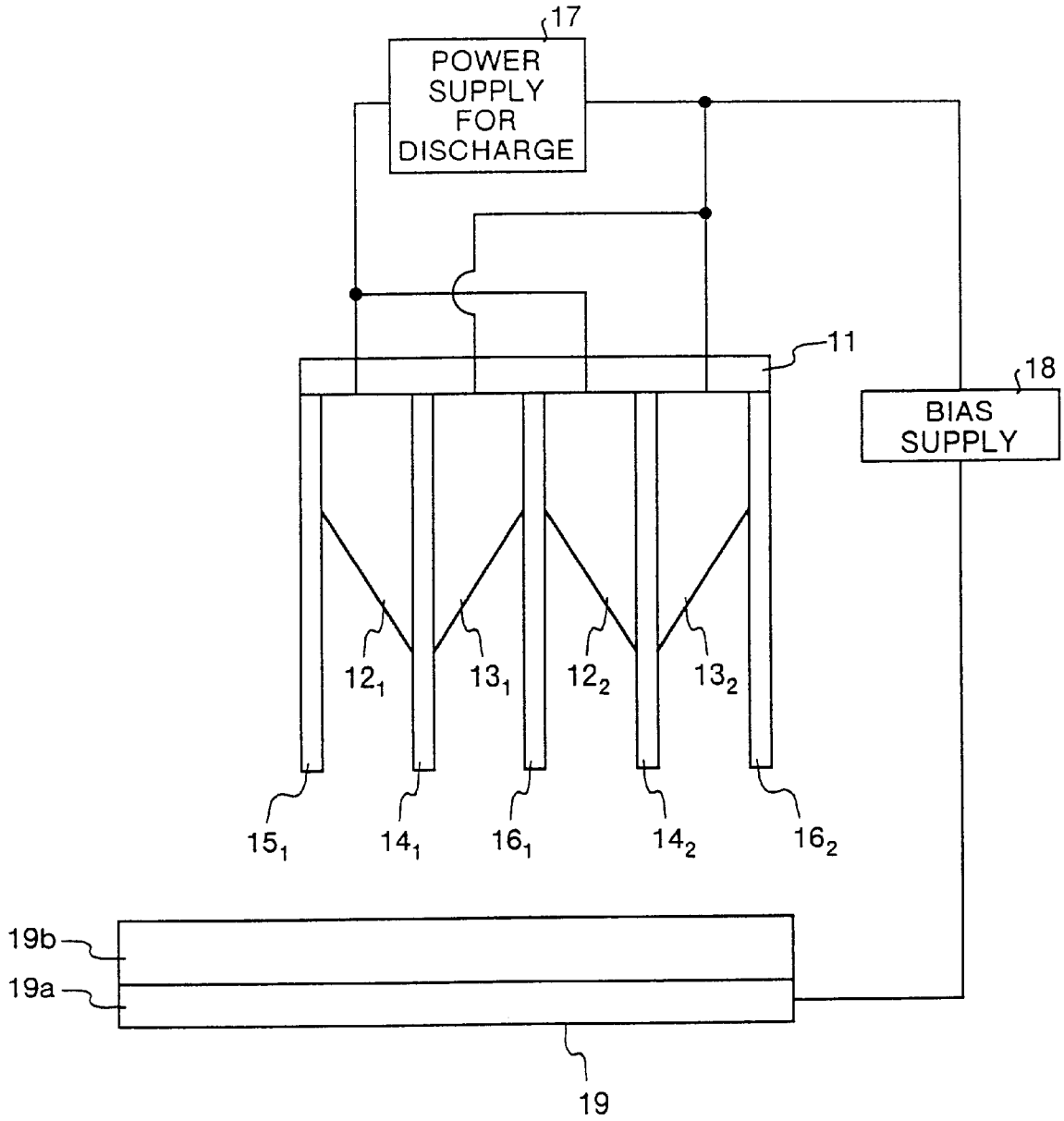
FIG. 17 is a cross section of a seventeenth embodiment of the invention.

FIG. 17 shows the seventeenth embodiment of the invention. The seventeenth embodiment is a charging device according to the fifteenth embodiment, in which in place of the electrodes 12 and 13, a plurality of sets of electrodes $\mathbf{12}_1$, $\mathbf{13}_1$, $\mathbf{12}_2$, and $\mathbf{13}_2$ are lined on the same plane of the electrical insulating substrate 11. Dielectric walls $\mathbf{14}_1$, to $\mathbf{16}_1$, $\mathbf{14}_2$, and $\mathbf{16}_2$ are provided on the substrate 11 so as to sandwich the electrodes $\mathbf{12}_1$, $\mathbf{13}_1$, $\mathbf{12}_2$, and $\mathbf{13}_2$ and to form roughly closed space around the electrodes $\mathbf{12}_1$, $\mathbf{13}_1$, $\mathbf{12}_2$, and $\mathbf{13}_2$. The spaces formed by the dielectrics $\mathbf{14}_1$, $\mathbf{15}_1$, $\mathbf{16}_1$, $\mathbf{14}_2$, and $\mathbf{16}_2$ and the electrodes $\mathbf{12}_1$, $\mathbf{13}_1$, $\mathbf{12}_2$, and $\mathbf{13}_2$ are ion generating areas.

The angle $\theta_1$ formed by the face on the side of each of the ion generating areas of the electrodes $\mathbf{12}_1$ and $\mathbf{12}_2$ and each of the walls $\mathbf{14}_1$, $\mathbf{15}_1$, $\mathbf{14}_2$, and $\mathbf{16}_1$ is the predetermined angle in a manner similar to the electrode 12 of the first embodiment and the angle ranging from 10 to 80 degrees is appropriate. The angle $\theta_2$ formed between the face of the ion generating areas of each of the electrodes $\mathbf{13}_1$ and $\mathbf{13}_2$ and each of the walls $\mathbf{14}_1$, $\mathbf{16}_1$, $\mathbf{14}_2$, and $\mathbf{16}_2$ is the predetermined angle in a manner similar to the electrode 12 of the sixteenth embodiment. The angle ranging from 170 to 100 degrees is appropriate.

The electrodes $\mathbf{12}_1$ and $\mathbf{12}_2$ are commonly connected and the electrodes $\mathbf{13}_1$ and $\mathbf{13}_2$ are commonly connected. When a voltage for discharge is applied from the discharge power source 17 across the electrodes $\mathbf{12}_1$ and $\mathbf{13}_1$, across the electrodes $\mathbf{13}_1$ and $\mathbf{12}_2$, and across the electrodes $\mathbf{12}_2$ and $\mathbf{13}_2$, a discharge occurs between the electrodes $\mathbf{12}_1$ and $\mathbf{13}_1$, between the electrodes $\mathbf{13}_1$ and $\mathbf{12}_2$, and between the electrodes $\mathbf{12}_2$ and $\mathbf{13}_2$. Ions generated by the discharge are emitted from the ion generating areas as the spaces formed by the walls $\mathbf{14}_1$, to $\mathbf{16}_1$, $\mathbf{14}_2$, and $\mathbf{16}_2$ and the electrodes $\mathbf{12}_1$, $\mathbf{13}_1$, $\mathbf{12}_2$, and 132 sandwiched by the walls to the photosensitive body 19, and the photosensitive layer $\mathbf{19}_b$ of the photosensitive body 19 is charged.

A eighteenth embodiment of the invention is a charging device according to the fifteenth embodiment, in which electrodes of the same shape are lined. In eighteenth embodiment, as compared with the charging device in which the electrode and the face of each of the dielectrics sandwiching the electrodes does not form a predetermined angle, a section in which the electric field intensity is high is formed. Therefore, a discharge occurs with a low voltage, and the ozone generating amount is reduced. As compared with the foregoing embodiment, the uniformity of charging is further improved and a member to be charged can be uniformly charged.

Figure 18:
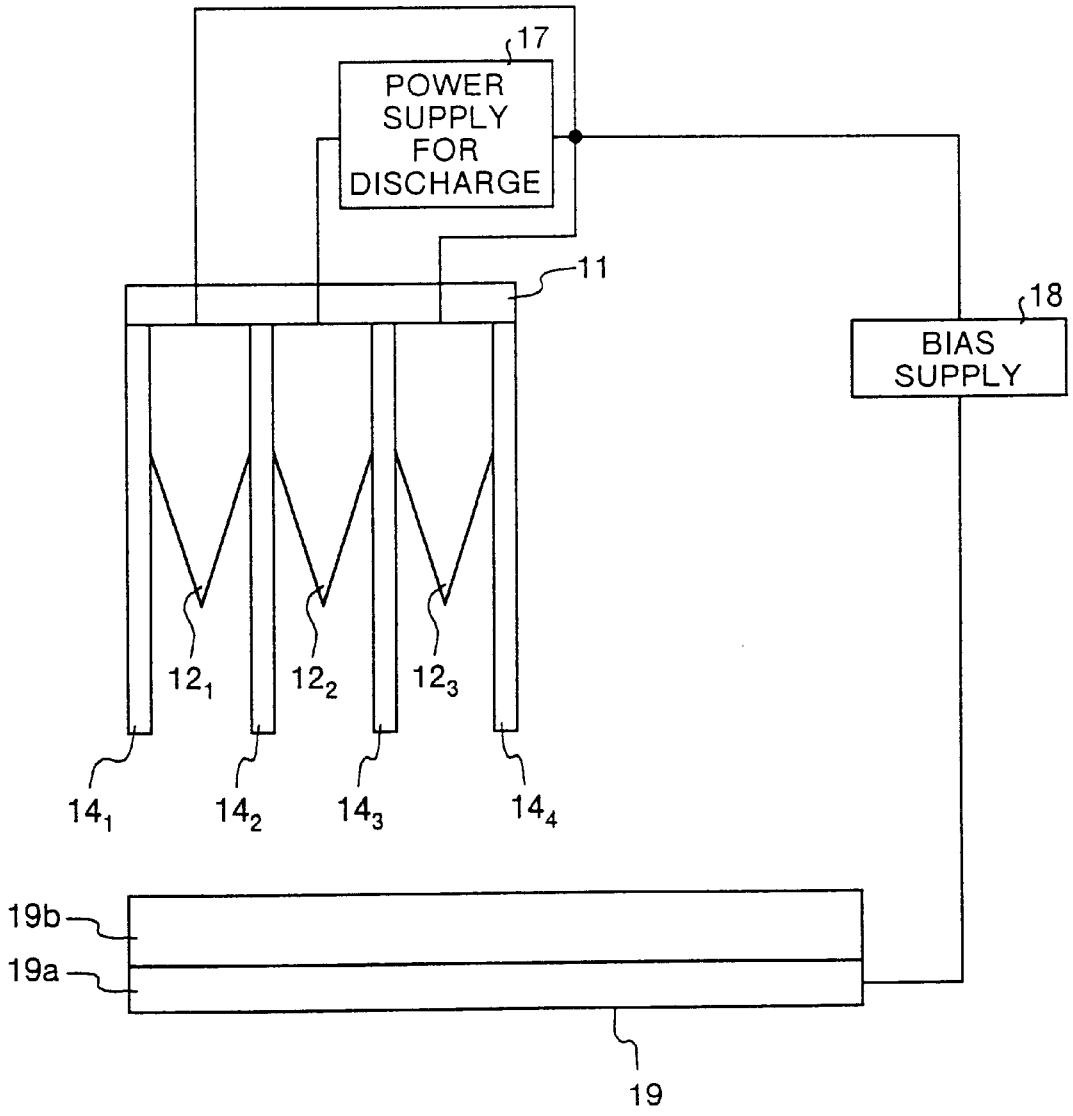
FIG. 18 is a cross section of a eighteenth embodiment of the invention.

FIG. 18 shows the eighteenth embodiment of the invention. The eighteenth embodiment is a charging device according to the fifteenth embodiment, in which in place of the electrodes 12 and 13 in the first embodiment, the electrodes of the same shape such as electrodes $\mathbf{12}_1$ to $\mathbf{12}_3$ each having a front end (part on the ion ejecting side) of a triangle shape in cross section (shape protruding in a V shape in the ion ejecting direction) are lined on the same plane of the electric insulating substrate 11. The dielectric walls $\mathbf{14}_1$ to $\mathbf{14}_4$ are provided so as to sandwich the electrodes $\mathbf{12}_1$ to $\mathbf{12}_3$ and to form roughly closed space around the electrodes $\mathbf{12}_1$ to $\mathbf{12}_3$. The spaces formed by the dielectric walls $\mathbf{14}_1$ to $\mathbf{14}_4$ and the electrodes $\mathbf{12}_1$ and $\mathbf{12}_3$ sandwiched by the dielectric walls $\mathbf{14}_1$ to $\mathbf{14}_4$ are ion generating areas.

The electrodes $\mathbf{12}_1$ and $\mathbf{12}_3$ are commonly connected. When a voltage for discharge is applied across the neighboring electrodes in the electrodes $\mathbf{12}_1$ to $\mathbf{12}_3$, a discharge occurs between the neighboring electrodes $\mathbf{12}_1$ to $\mathbf{12}_3$. The ions generated by the discharge are emitted by a potential difference obtained by the bias supply from the ion generating areas as the spaces formed by the walls $\mathbf{14}_1$ to $\mathbf{14}_4$ and the electrodes $\mathbf{12}_1$ to $\mathbf{12}_3$ sandwiched by the walls to the photosensitive body 19, and the photosensitive layer 19*b* of the photosensitive body 19 is charged.

Figure 19:
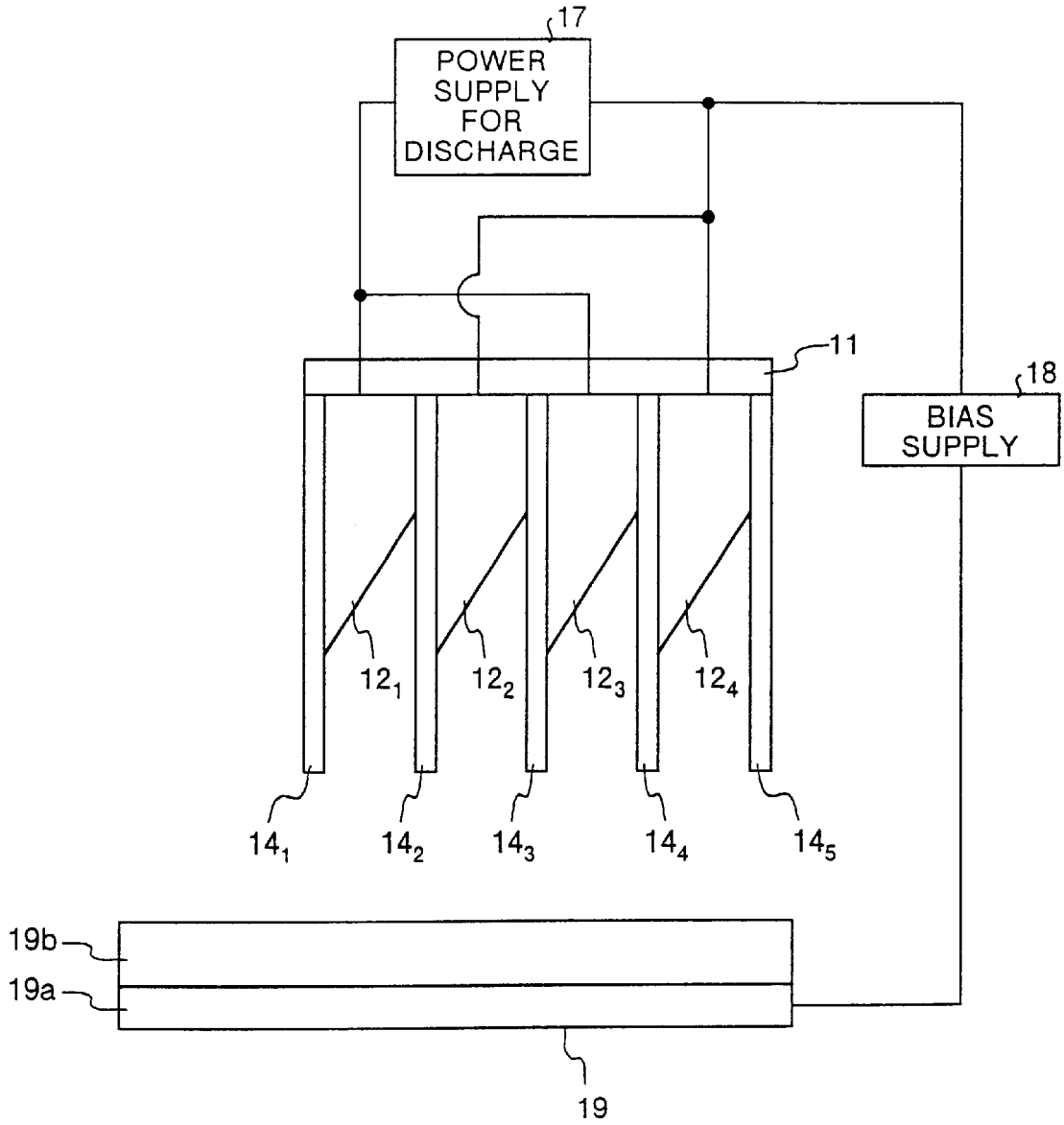
FIG. 19 is a cross section of a nineteenth embodiment of the invention.

FIG. 19 shows a nineteenth embodiment of the invention. The nineteenth embodiment is a charging device according to the eighteenth embodiment, in which each of the number of electrodes and the number of walls in the fourth embodiment is increased by one and the shape of each of the electrodes $\mathbf{12}_1$ to $\mathbf{12}_4$ is similar to that of the electrode 12 in the second embodiment. The angle $\theta_2$ formed by the face on the ion generating area of each of the electrodes $\mathbf{12}_1$ to $\mathbf{12}_4$ and each of the walls $\mathbf{14}_1$ to $\mathbf{14}_5$ is the predetermined angle in a manner similar to the electrode 12 in the second embodiment. An appropriate angle ranges from 170 to 100 degrees.

A twentieth embodiment of the invention is a charging device according the eighteenth embodiment, in which the central part (face in the ion emitting direction) in cross section of the electrode has a recessed shape. In the twentieth embodiment, as compared with the eighteenth embodiment, a discharge occurs with a lower voltage and the ozone generating amount is further reduced.

Figure 20:
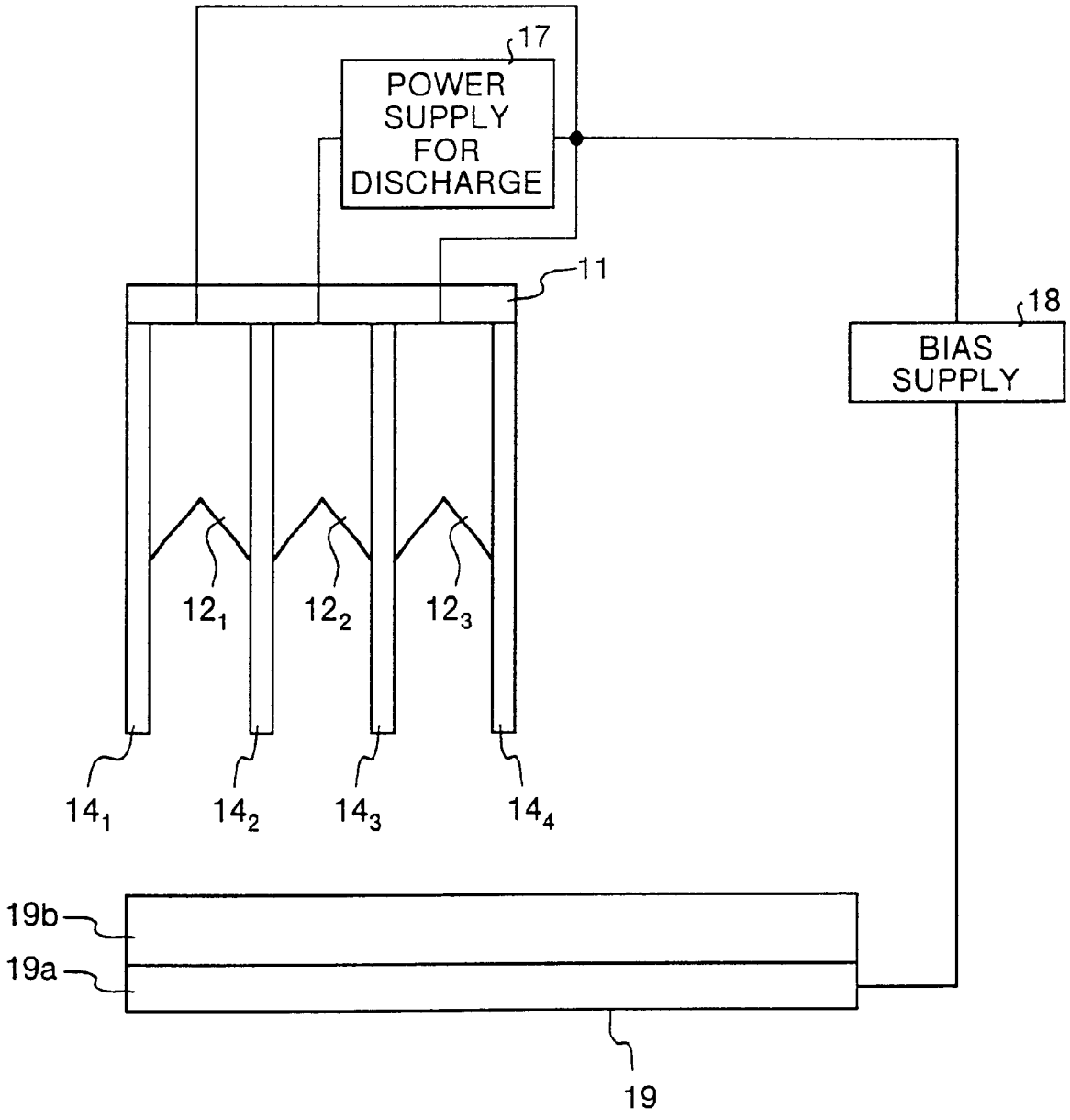
FIG. 20 is a cross section of a twentieth embodiment of the invention.

FIG. 20 shows the twentieth embodiment of the invention. The twentieth embodiment is a charging device according to the eighteenth embodiment, in which the front end in the ion emitting direction of each of the electrodes $\mathbf{12}_1$ to $\mathbf{12}_3$ has a V-shaped recess. The recessed part at the front end of each of the electrodes $\mathbf{12}_1$ to $\mathbf{12}_3$ may be a curved face.

In any of the fifteenth to twentieth embodiments, the number of electrodes may be three or more. In this case, the discharge area is widened and the charging can be performed more uniformly. At least one, preferably more than two, of the fifteenth to twentieth embodiments may be applied.

A twenty-first embodiment of the invention is a charging device using spaces formed by dielectrics and electrodes as ion generating areas, in which neighboring electrodes have a step in the ion ejecting direction and three or more electrodes are arranged. The electrode sandwiched via dielectrics between the electrodes is recessed in the ion ejecting direction from the electrodes on both sides. Thus, in the embodiment, as compared with the case where there is no step in the ion ejecting direction in the neighboring electrodes, the area where the electric field intensity is high is formed. Therefore, a discharge occurs with a low voltage, and the ozone generating amount can be reduced.

Figure 21:
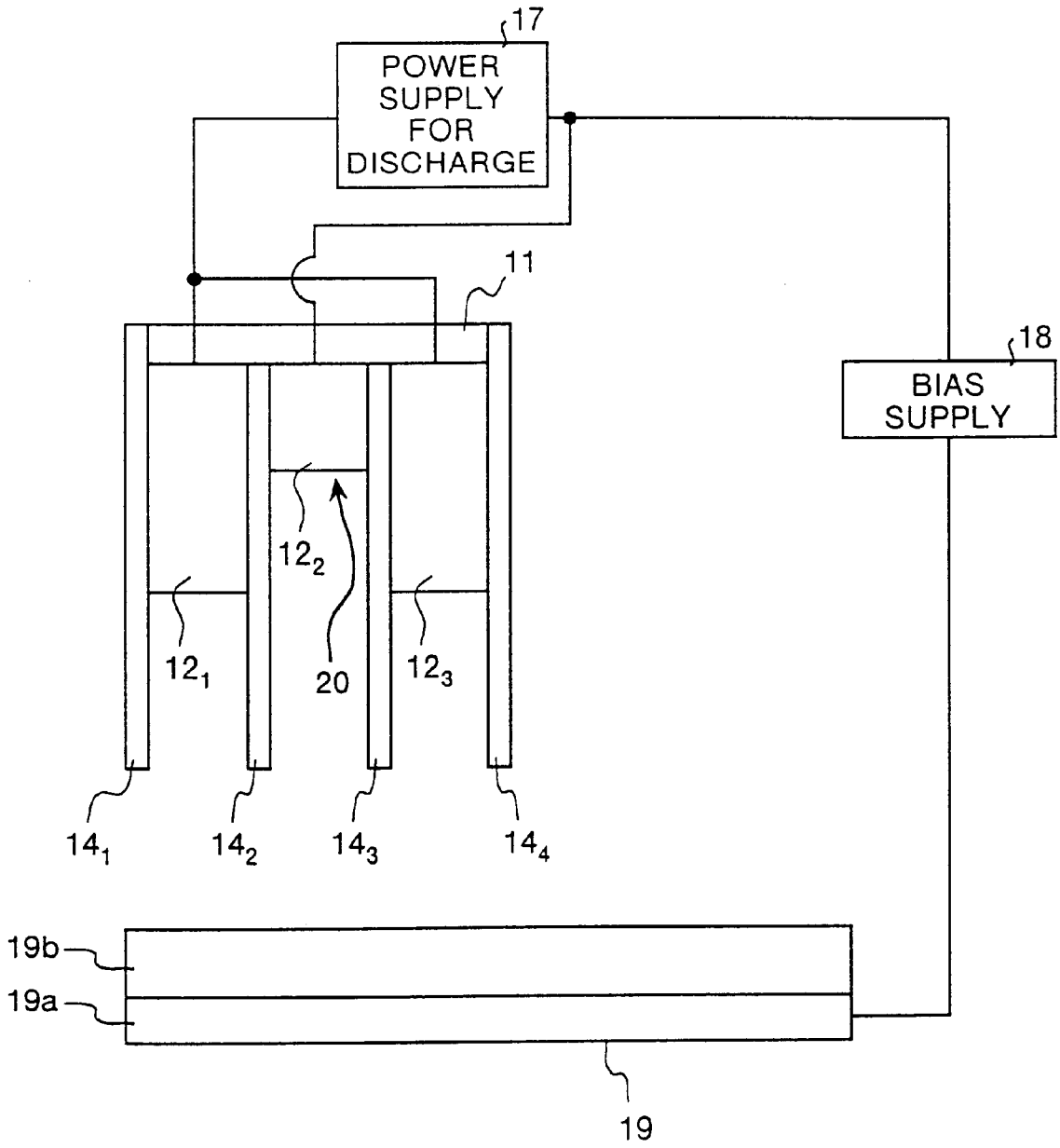
FIG. 21 is a cross section of a twenty-first embodiment of the invention.

FIG. 21 shows the twenty-first embodiment of the invention. The twenty-first embodiment is a charging device according to the eighteenth embodiment, in which the front end of each of the electrodes $\mathbf{12}_1$ to $\mathbf{12}_3$ is formed flatly and the front end of the electrode $\mathbf{12}_2$ is recessed in the ion ejecting direction as compared with the front end of each of the electrodes $\mathbf{12}_1$ and $\mathbf{12}_3$.

Figure 22:
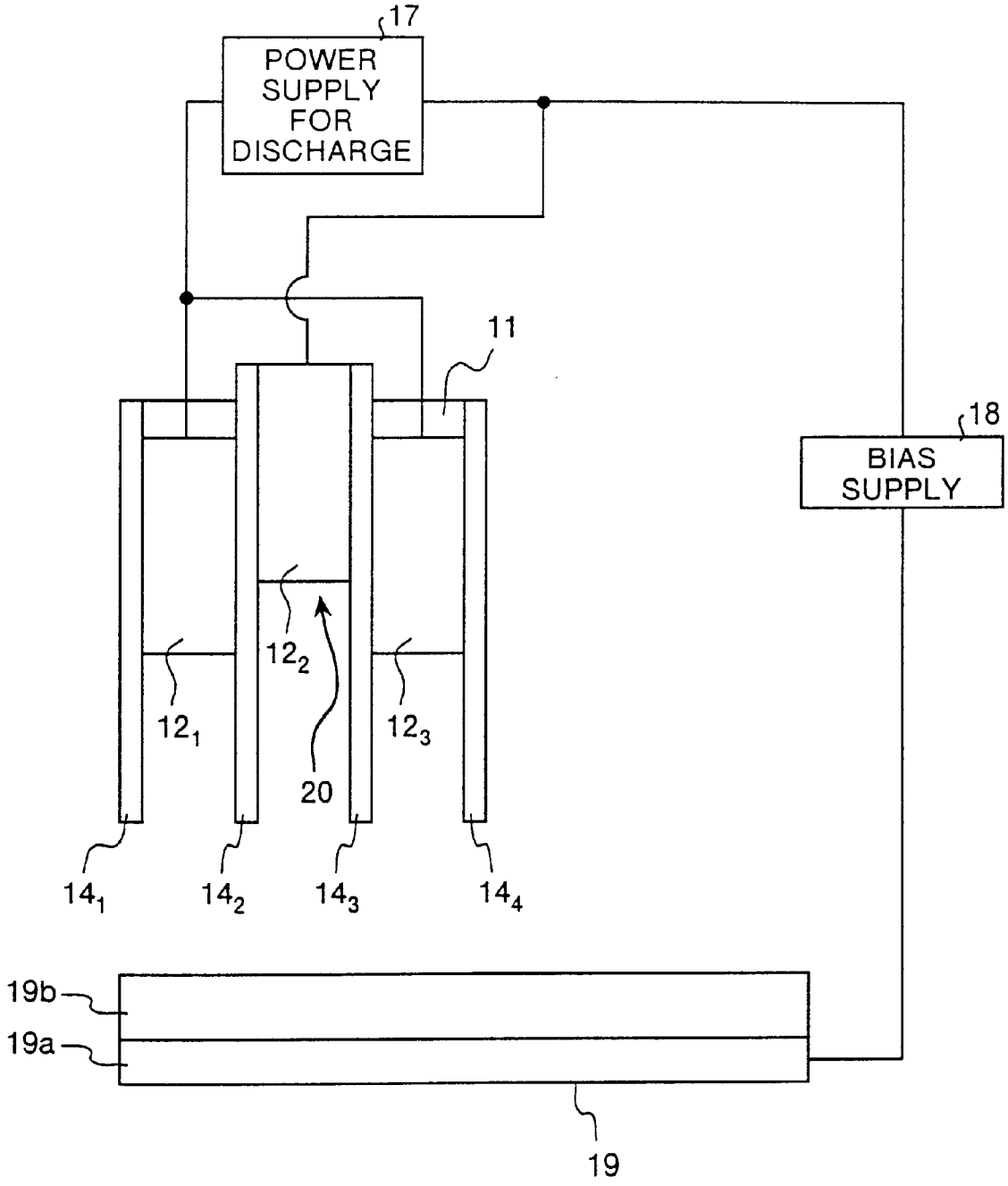
FIG. 22 is a cross section of an twenty-second embodiment of the invention.

FIG. 22 shows an twenty-second embodiment of the invention. The twenty-second embodiment is a charging device according to the twenty-first embodiment, in which the rear end of each of the electrode $\mathbf{12}_2$ and the walls $\mathbf{14}_2$ and $\mathbf{14}_3$ is projected in the opposite direction of the ion ejecting direction from the substrate 11. In the twenty-first and twenty-second embodiments, a part 20 obtained by making the front end of the electrode $\mathbf{12}_2$ recess as compared with the front end of each of the electrodes $\mathbf{12}_1$ and $\mathbf{12}_3$ is an area where the electric field intensity is high.

A twenty-third embodiment of the invention is a charging device according to the nineteenth embodiment, in which neighboring electrodes have a step in the ion ejecting direction and three or more electrodes are lined. The electrode sandwiched via dielectrics between the electrodes is recessed in the ion ejecting direction from the electrodes on both sides. Thus, in this embodiment, the area where the electric field intensity is high is formed. Therefore, a discharge occurs with a low potential, and the ozone generating amount is reduced.

Figure 23:
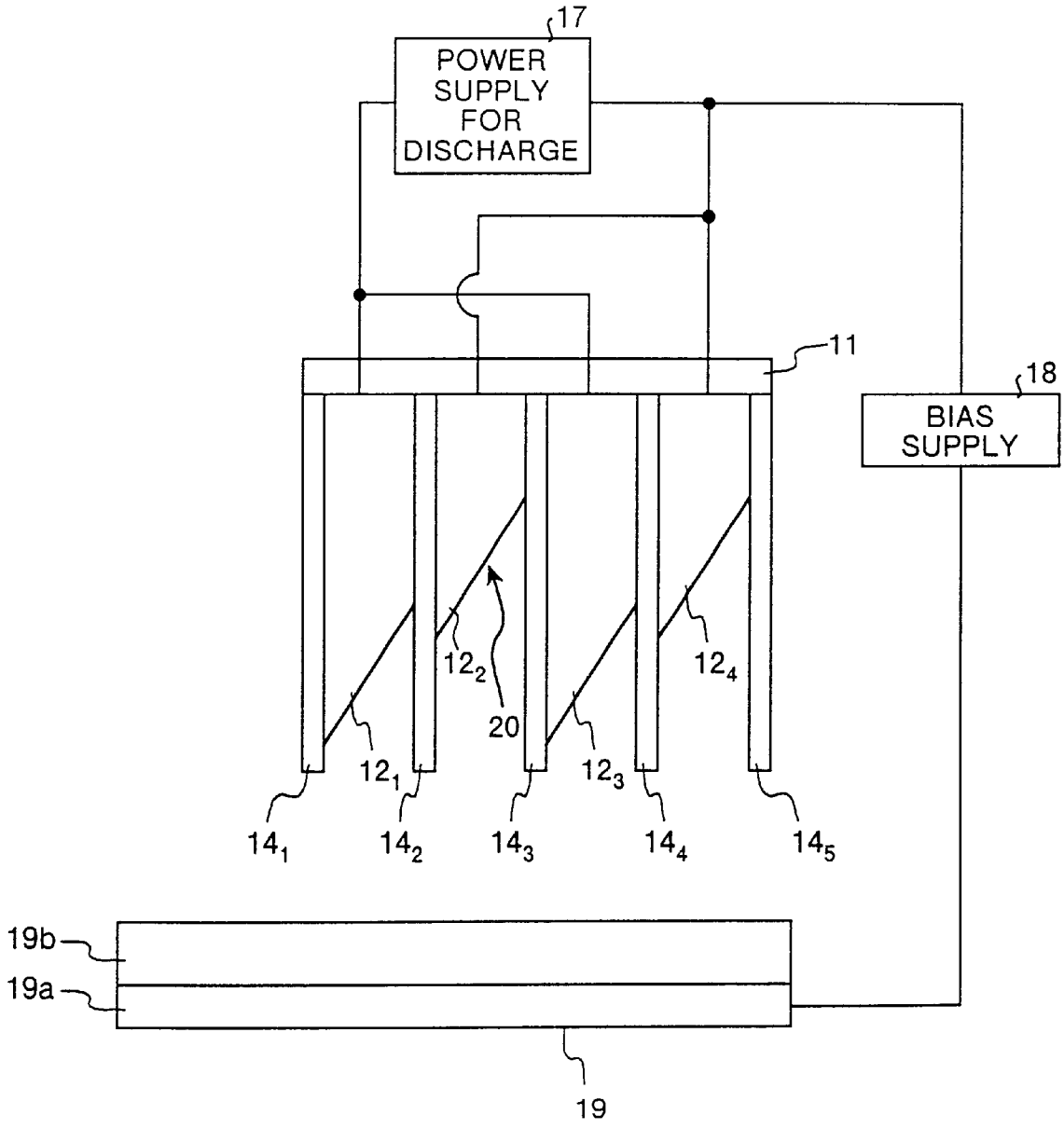
FIG. 23 is a cross section of a twenty-third embodiment of the invention.

FIG. 23 shows the twenty-third embodiment of the invention. The twenty-third embodiment is a charging device according to the nineteenth embodiment, in which the neighboring electrodes $\mathbf{12}_1$ to $\mathbf{12}_4$ have steps in the ion ejecting direction. The electrode $\mathbf{12}_2$ sandwiched by the electrodes $\mathbf{12}_1$ and $\mathbf{12}_3$ via the dielectric walls $\mathbf{14}_2$ and $\mathbf{14}_3$ is recessed in the ion ejecting direction as compared with the electrodes $\mathbf{12}_1$ and $\mathbf{12}_3$ on both sides of the electrode $\mathbf{12}_2$.

Figure 24:
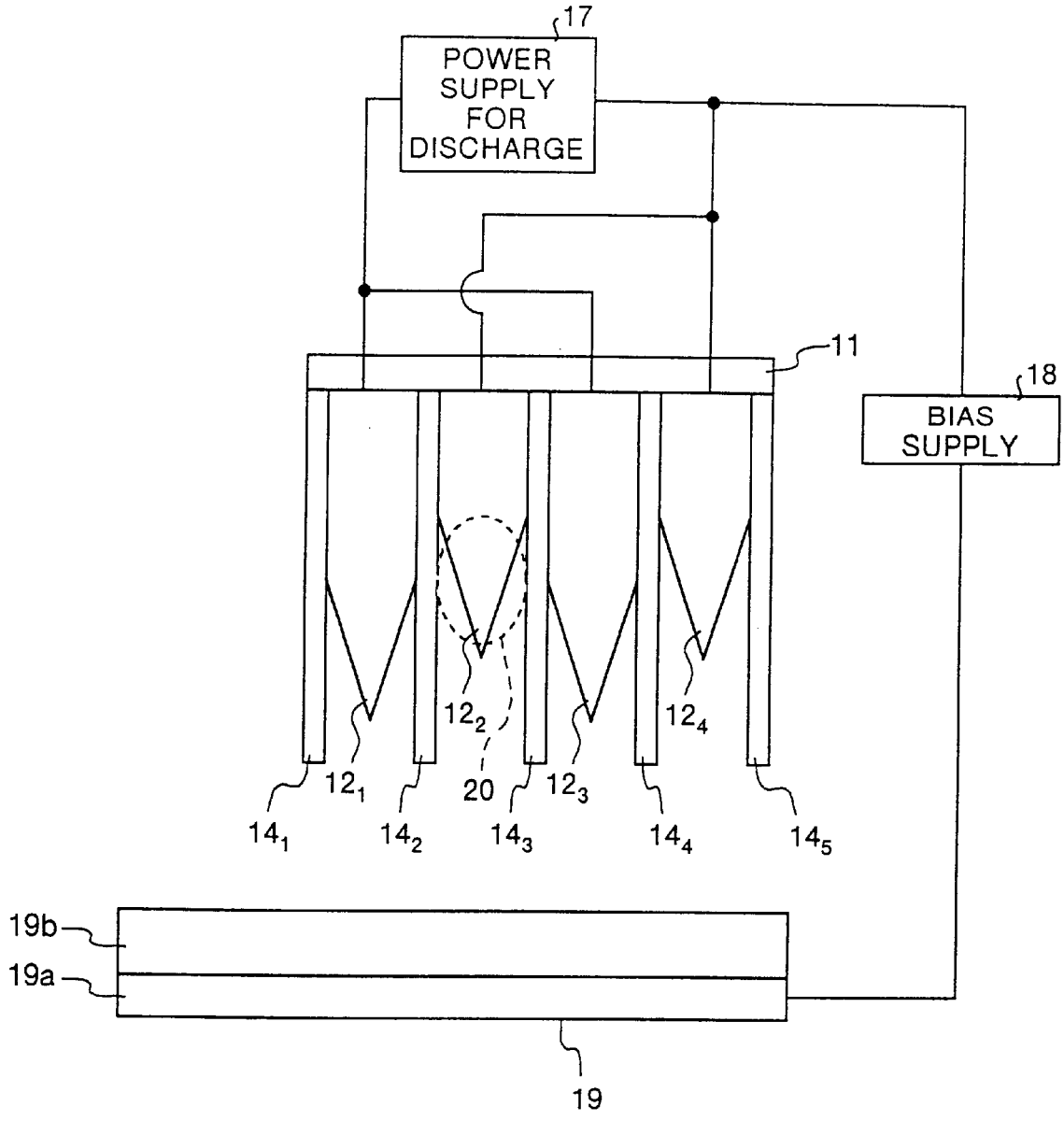
FIG. 24 is a cross section of a twenty-fourth embodiment of the invention.

FIG. 24 shows a twenty-fourth embodiment of the invention. The twenty-fourth embodiment is a charging device according to the twenty-third embodiment, in which the front end of (part on the ion ejection side) of each of the electrodes $\mathbf{12}_1$ to $\mathbf{12}_4$ has a triangle shape in cross section (V-shape projecting in the ion ejecting direction). In the twenty-third and twenty-fourth embodiments, the part 20 obtained by recessing the electrode $\mathbf{12}_2$ sandwiched by the electrodes $\mathbf{12}_1$ and $\mathbf{12}_3$ via the dielectric walls $\mathbf{14}_2$ and $\mathbf{14}_3$ is an area where the electric field intensity is high.

A twenty-fifth embodiment of the invention is a charging device according to the seventeenth embodiment, in which the neighboring symmetrical electrodes are paired and the pair of electrodes is sandwiched by the dielectrics. The pair of electrodes is arranged so as to be recessed in the ion ejecting direction as compared with the electrodes at both ends of the dielectrics and the pair of electrodes. Thus, in the embodiment, an area where the electric field intensity is high is formed. Therefore, a discharge occurs with a low potential, and the ozone generating amount is reduced.

Figure 25:
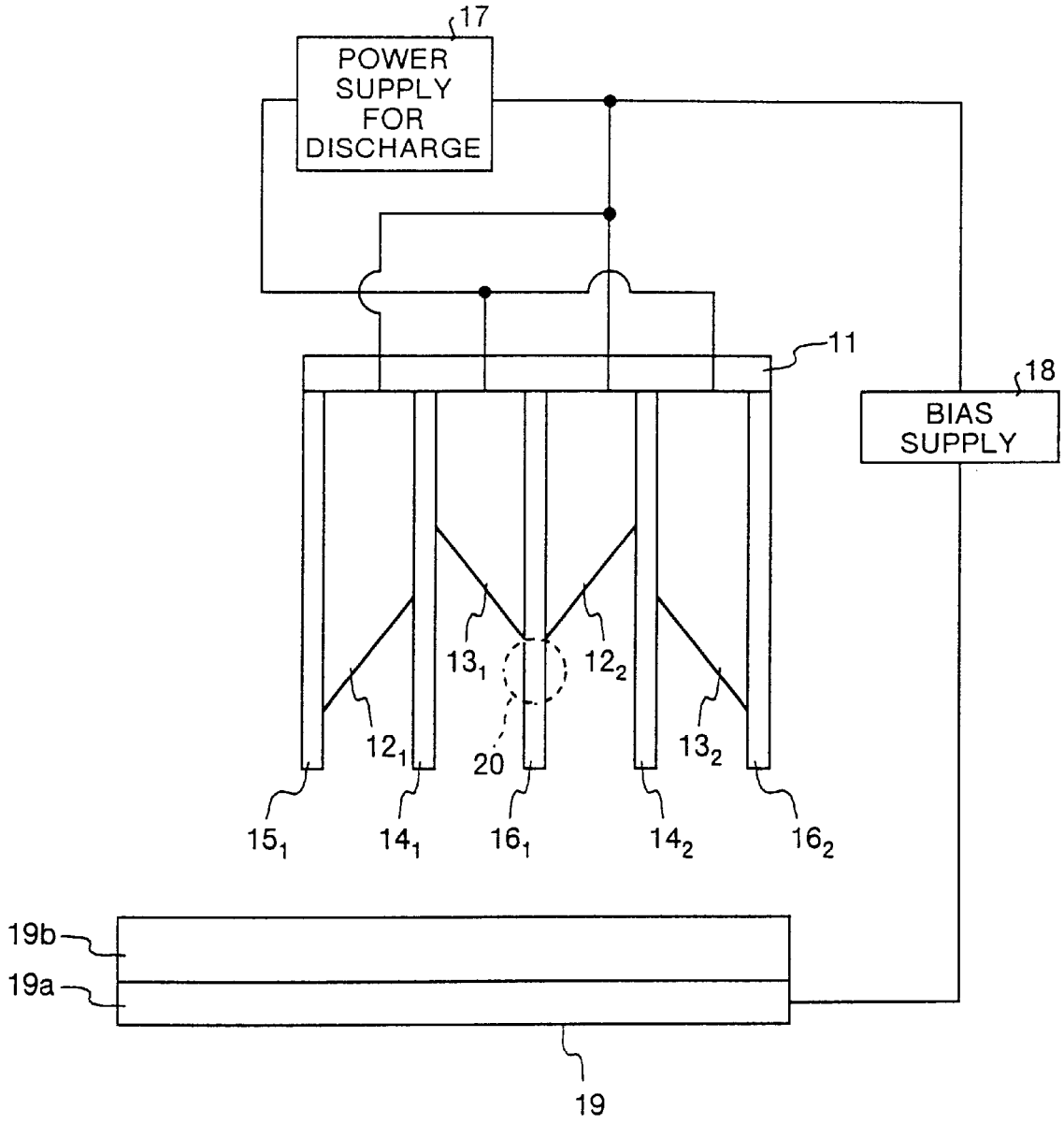
FIG. 25 is a cross section of a twenty-fifth embodiment of the invention.

FIG. 25 shows the twenty-fifth embodiment of the invention. The twenty-fifth embodiment is a charging device according to the twentieth embodiment, in which the neighboring symmetrical electrodes $\mathbf{13}_1$ and $\mathbf{12}_2$ are paired and the pair of electrodes $13_1$ and $12_2$ is sandwiched by the dielectrics $14_1$, $16_1$, and $14_2$. The pair of electrodes $13_1$ and $12_2$ is arranged so as to be recessed in the ion ejecting direction as compared with the electrodes $12_1$ and $13_2$ on both side of the part including the dielectrics $14_1$, $16_1$, and $14_2$ and the pair of electrodes $13_1$ and $12_2$. In the part 20 obtained by making the pair of electrodes $13_1$ and $12_2$ recesses in the ion ejecting direction as compared with the dielectrics $14_1$, $16_1$, and $14_2$ and the pair of electrodes $13_1$ and $12_2$, the electric field intensity is high. 20 The angle $\theta_1$ formed by the face on the ion generating area side of each of the electrodes $12_1$ to $12_2$ and each of the walls $14_1$, $15_1$, $14_2$ and $16_1$ is the predetermined angle in a manner similar to the electrode 12 in the sixteenth embodiment. An appropriate angle ranges from 170 to 100 degrees. The angle $\theta_1$ formed by the face on the ion generating area side of each of the electrodes $13_1$ and $13_2$ and each of the walls $14_1$, $16_1$, $14_2$ and $16_2$ is the predetermined angle in a manner similar to the electrode 12 of the fifteenth embodiment. An appropriate angle ranges from 10 to 80 degrees.

In the twenty-fifth embodiment of the invention, at least four electrodes are necessary.

A twenty-sixth embodiment of the invention is a charging device according to the twenty-fifth embodiment, in which long electrodes sandwich the pair of short symmetrical electrodes via the dielectric walls. In the embodiment, as compared with the case where the electrodes on both sides are not longer with respect to the pair of neighboring symmetrical electrodes, the areas are formed by the recessed pair of electrodes and the electrodes on both sides. In the areas, the electric field intensity is higher. A discharge occurs with a low potential. Therefore, the ozone generating amount is reduced.

Figure 26:
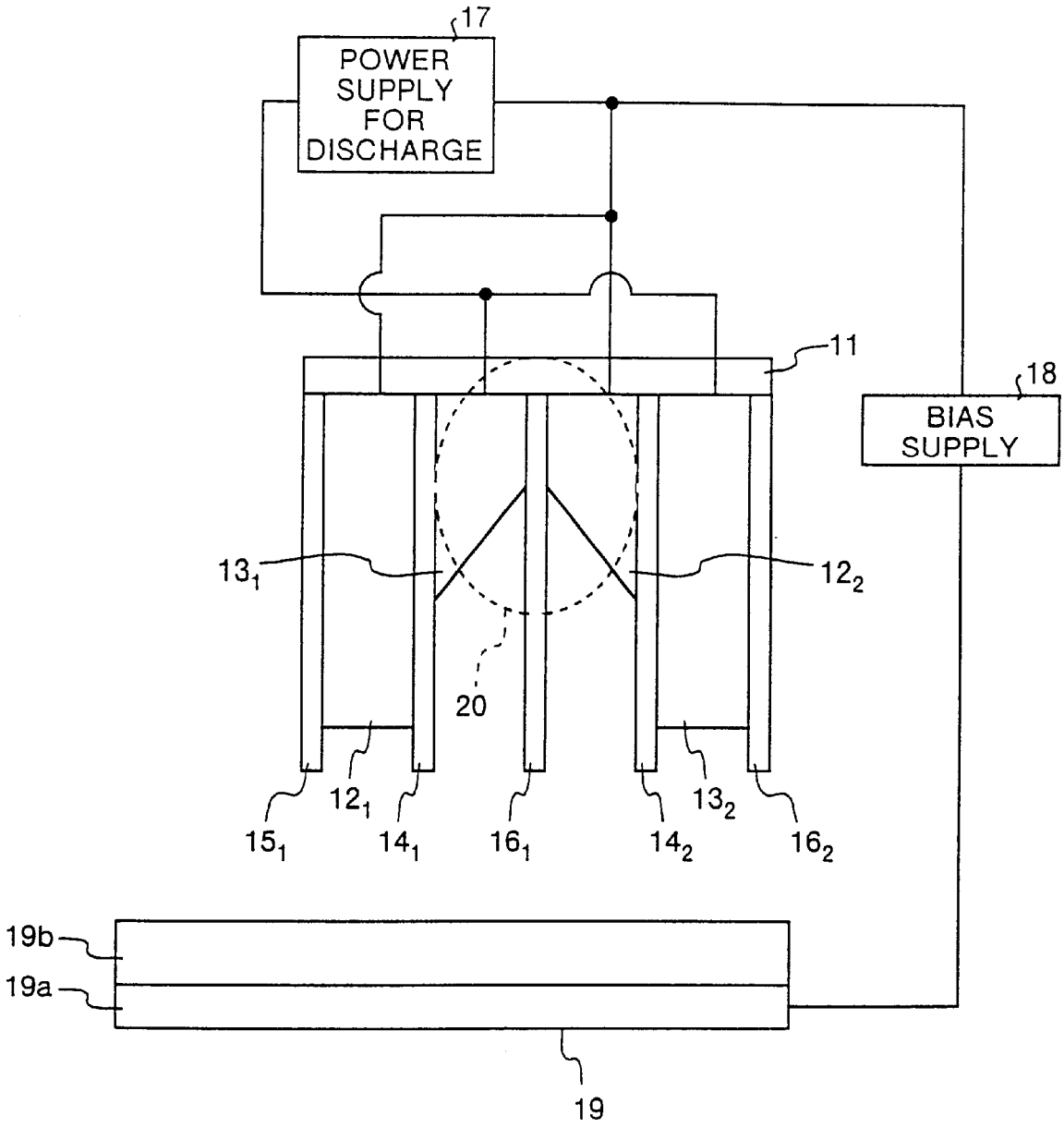
FIG. 26 is a cross section of a twenty-sixth embodiment of the invention.

FIG. 26 shows the twenty-sixth embodiment of the invention. The twenty-sixth embodiment is a charging device according to the twenty-fifth embodiment, in which the angle $\theta_2$ formed by the face on the ion generating area side of the electrode $13_1$ and each of the walls $14_1$ and $16_1$ is the predetermined angle in a manner similar to the electrode 12 of the sixteenth embodiment. An appropriate angle ranges from 170 to 100 degrees.

The angle $\theta_1$ formed by the face on the ion generating area side of the electrode $12_2$ and each of the walls $16_1$ and $14_2$ is the predetermined angle in a manner similar to the electrode 12 of the fifteenth embodiment and an appropriate angle ranges from 10 to 80 degrees. The face on the ion generating area side of each of the electrodes $12_1$ and $13_2$ is formed to be flat. The neighboring symmetrical pair of short electrodes $13_1$ and $12_2$ are sandwiched by the long dielectrics $14_1$, $16_1$, and $14_2$ so as to produce a larger sandwiched space.

Figure 27:
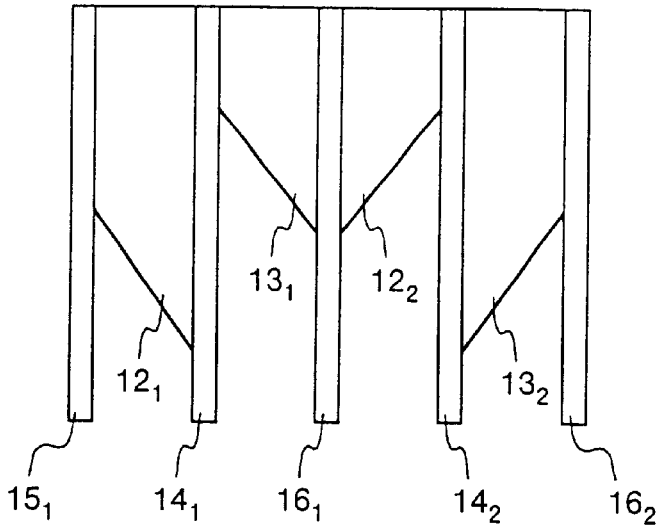
FIG. 27 is a cross section of electrodes and walls in a twenty-seventh embodiment of the invention.

FIG. 27 shows electrodes and walls in a twenty-seventh embodiment of the invention. The twenty-seventh embodiment is a charging device according to the twenty-sixth embodiment, in which the angle 01 formed by the face on the ion generating area side of each of the electrodes $12_1$ and $13_1$ and each of the walls $14_1$ to $16_1$ is the predetermined angle in a manner similar to the electrode 12 of the fifteenth embodiment. An appropriate angle ranges from 10 to 80 degrees. The angle $\theta_2$ formed by the face on the ion generating area side of each of the electrodes $12_2$ and $13_2$ and each of the walls $16_1$, $14_2$, and $16_2$ is the predetermined angle in a manner similar to the electrode 12 in the sixteenth embodiment. An appropriate angle ranges from 170 to 100 degrees.

Figure 28:
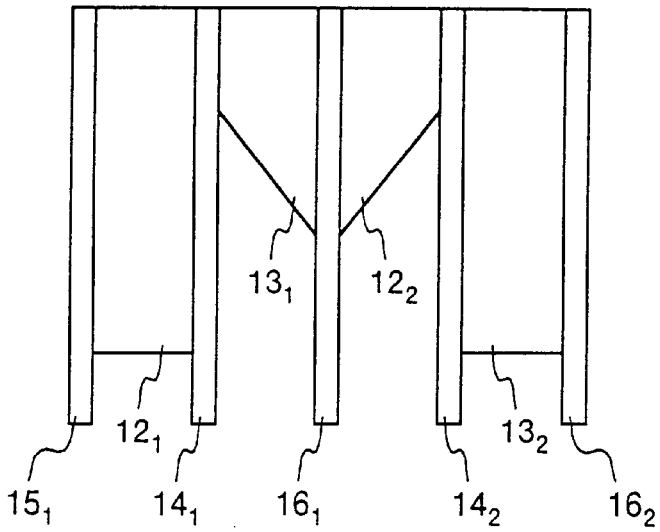
FIG. 28 is a cross section of electrodes and walls in a twenty-eighth embodiment of the invention.

FIG. 28 shows electrodes and walls in a twenty-eighth embodiment. The twenty-eighth embodiment is a charging device according to the twenty-seventh embodiment, in which the face on the ion ejecting area side of each of the electrodes $12_1$ and $13_2$ is flat.

A twenty-ninth embodiment, of the invention is a charging device according to the twenty-eighth embodiment two or more sets each having the pair of electrodes, the dielectrics and the electrodes on both sides are lined. In the embodiment, the discharge area is widened and charging can be uniformly performed.

Figure 29:
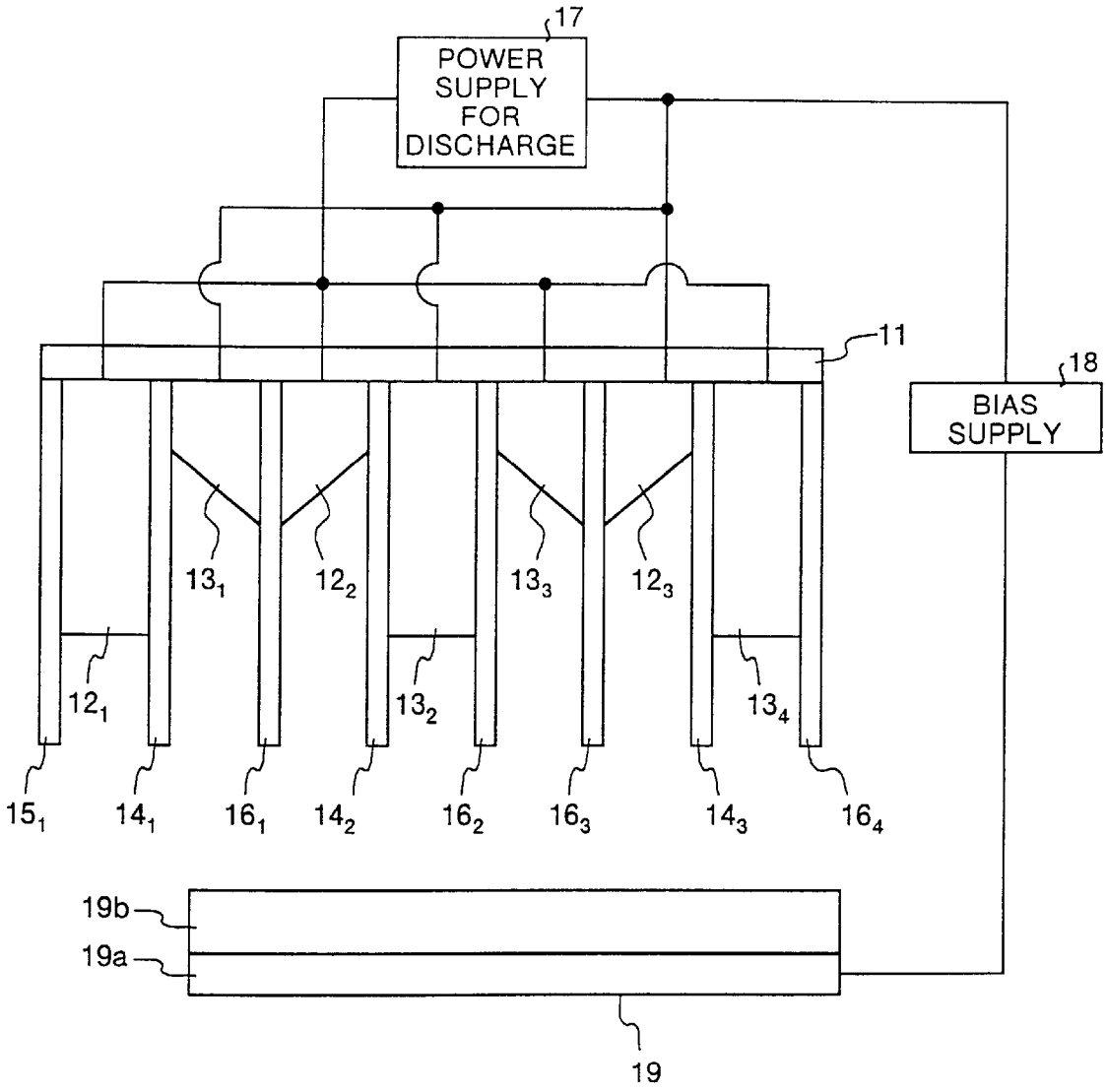
FIG. 29 is a cross section of a twenty-ninth embodiment of the invention.

FIG. 29 shows the twenty-ninth embodiment of the invention. The twenty-ninth embodiment is a charging device according to the twenty-eighth embodiment, in which two or more sets each comprising the electrodes $12_1$, $13_1$, $12_2$, and $13_2$ and the dielectric walls $14_1$, $15_1$, $16_1$, $14_2$ and $16_2$ are lined. For example, the electrodes $12_1$, $13_1$, $12_2$, $13_2$, $13_3$, $12_3$, and $13_4$ and the dielectric walls $14_1$ to $16_1$, $14_2$, $16_2$, $16_3$, $14_3$, and $16_4$ are lined. In each of the twenty-fifth and twenty-sixth embodiments, two or more sets each having the pair of electrodes, the dielectrics, and the electrodes on both sides may be lined.

A thirtieth embodiment is a charging device according to in any of the fifteenth to twenty-ninth embodiments, a grid electrode is provided between the ion generating area and the photosensitive body 19 as a body to be charged. Thus, a desired charge potential can be more certainly obtained.

Figure 30:
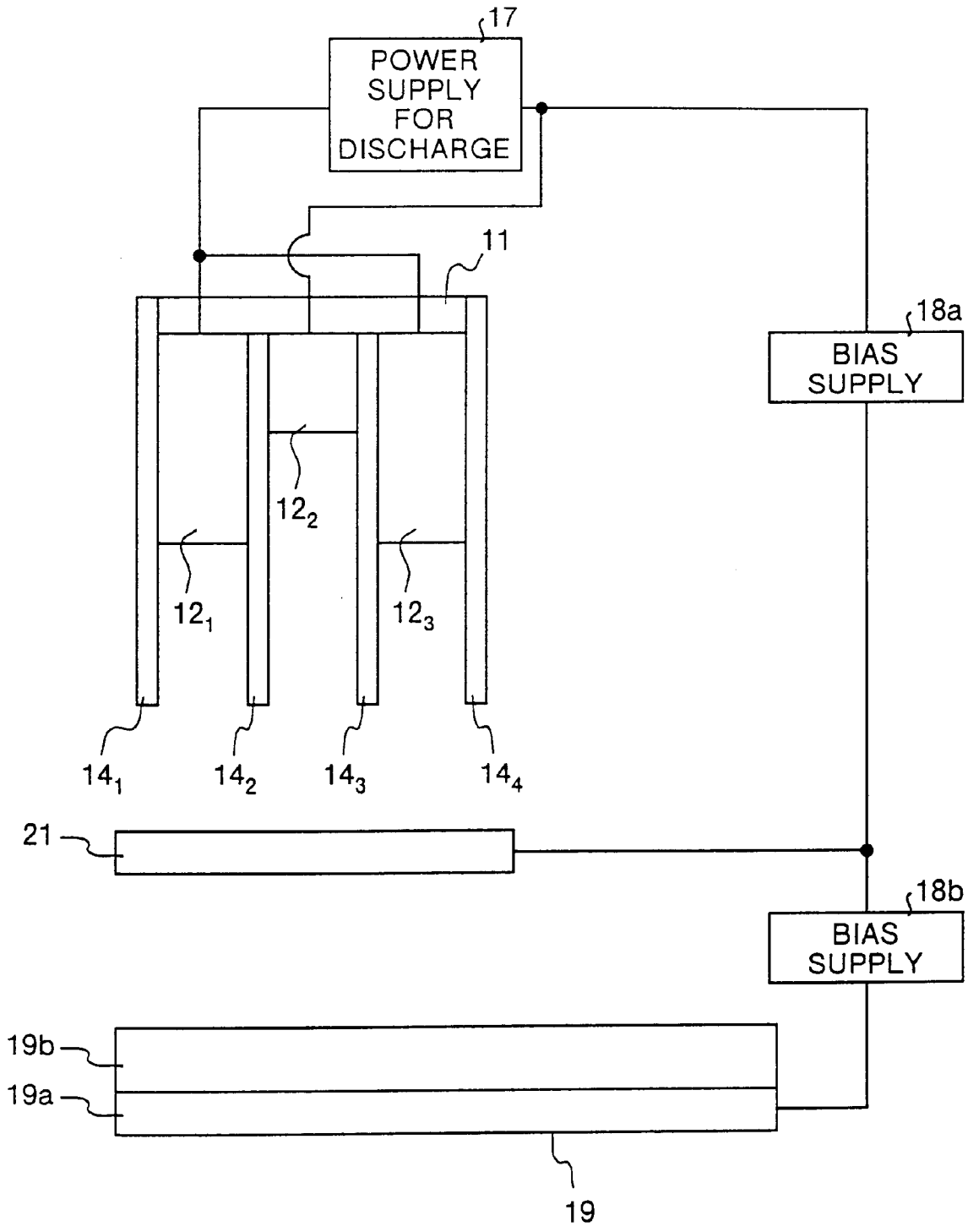
FIG. 30 is a cross section of a thirtieth embodiment of the invention

FIG. 30 shows the thirtieth embodiment of the invention. The thirtieth embodiment is a charging device according to the twenty-first embodiment, in which a grid electrode 21 is provided between the ion generating area and the photosensitive body 19, the bias supply 18*a* is connected between the electrode $12_2$ and the grid electrode 21, and a bias supply 18*b* is connected between the grid electrode 21 and the substrate 19*a* of the photosensitive body 19.

In the fifteenth to twentieth embodiments and the twenty-second to twenty-ninth embodiments, it is also possible to provide the grid electrode 21 between the ion generating area and the photosensitive body 19, connect the bias supply 18*a* between the electrode $12_2$ and the grid electrode 21, and connect the bias supply 18*b* between the grid electrode 21 and the substrate 19*a* of the photosensitive body 19.

Thirty-first embodiment of the invention is an electrophotographic apparatus on which any one of the charging devices of the fifteenth to twenty-eighth embodiments is mounted. In this electrophotographic apparatus, the components except for the charging device are well-known. For example, a photosensitive body is uniformly charged by any one of the charging devices of the fifteenth to twenty-eighth embodiments and exposed by an exposing unit to form an electrostatic latent image, and the electrostatic latent image on the photosensitive body is developed by a developing unit, thereby obtaining a toner image. The toner image on the photosensitive body is transferred by a transfer unit to a transfer member such as a sheet of paper or to an intermediate transfer member and then to a transfer member such as a sheet of paper. The toner image on the transfer member is fixed by a fixing device. In the embodiment, an electrophotographic apparatus which produces a small amount of ozone exhaust without using an ozone filter can be realized.

Figure 31:
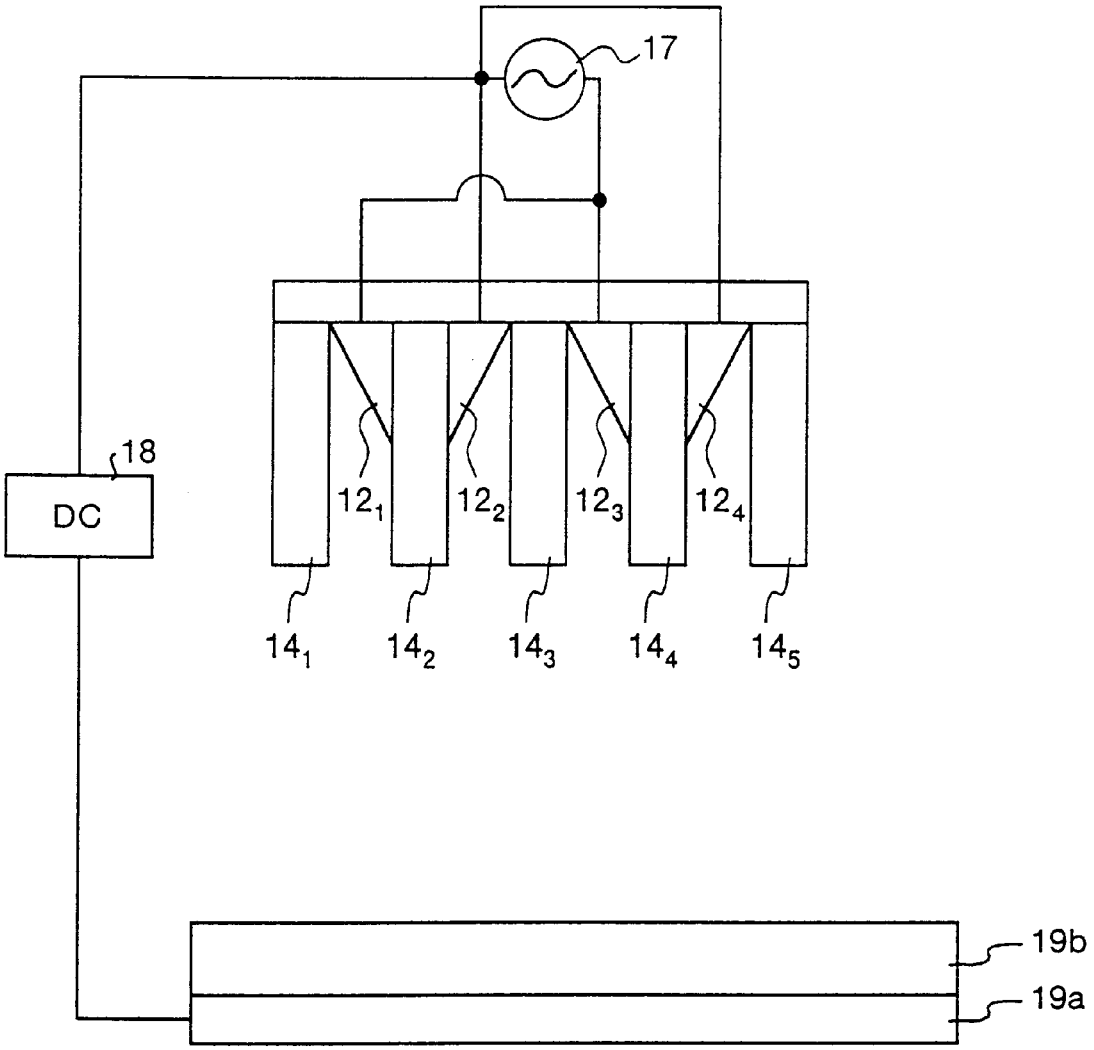
FIG. 31 is a cross section of example 1 of the invention.
Figure 32:
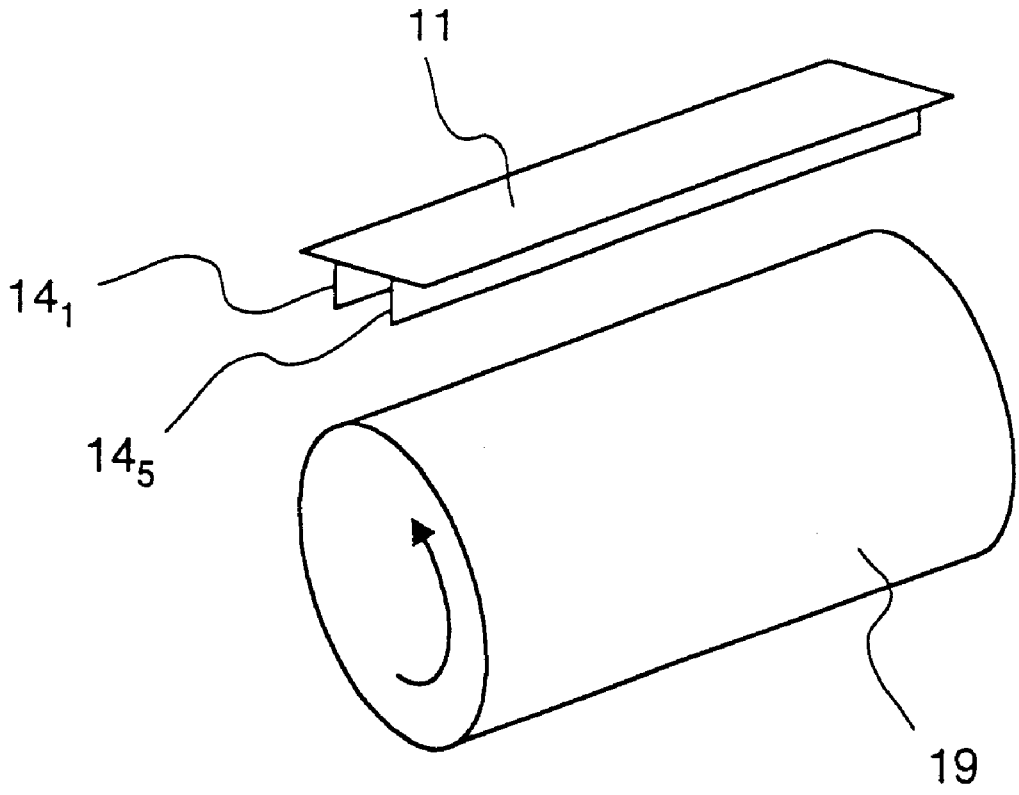
FIG. 32 is a schematic diagram of example 1.

FIG. 31 and FIG. 32 show an example 1. The example 1 relates to the nineteenth embodiment. The face on the ion generating area side of each of the electrodes $12_1$ and $12_2$ and each of the walls $14_1$, $14_2$, and $14_3$ is the predetermined angle in a manner similar to the electrode 12 in the sixteenth embodiment. As the power source 17 for discharge, an AC power supply of 50 Hz was used. As a bias supply 18, a DC power supply was used. The charging device of the example 1 was set below the drum-shaped photosensitive body 19 as a rotatable body to be charged.

The voltages of the power supplies 17 and 18 were set so that the charge potential of the photosensitive body 19 becomes −800V when the photosensitive body 19 is rotated at constant linear velocity. The following parameters were also set. linear velocity of the photosensitive body 19: 100 mm/sec material of electrode: tungsten material of dielectric: PFA predetermined angles: 30 degrees, 150 degrees When ozone smell around the charging device of the example 1 was measured, there was no ozone smell as shown in FIG. 34.

In example 2 of the invention, an experiment similar to the example 1 was carried out in the nineteenth embodiment. As the power source 17 for discharge, an AC power supply of 50 Hz was used. As a bias supply 18, a DC power supply was used. The charging device of the example 2 was set below the drum-shaped photosensitive body 19 as a rotatable body to be charged. The voltages of the power sources 17 and 18 were set so that the charge potential of the photosensitive body 19 becomes −800V when the photosensitive body 19 is rotated at constant linear velocity. The following parameters were also set.

linear velocity of the photosensitive body 19: 100 mm/sec material of electrode: tungsten material of dielectric: PFA predetermined angles: 30 degrees, 150 degrees When ozone smell around the charging device of the example 2 was measured, there was no ozone smell as shown in FIG. 34.

An example 3 of the invention relates to a charging device similar to that of the sixteenth embodiment. When an experiment similar to the example 1 was carried out, there was no ozone smell around the charging device of the example 3 as shown in FIG. 34. An example 4 of the invention relates to a charging device similar to that of the twenty-second embodiment. When an experiment similar to the example 1 was carried out, there was no ozone smell around the charging device as shown in FIG. 34.

An example 5 of the invention relates to a charging device similar to that of the twenty-fourth embodiment. When an experiment similar to that of the example 1 was carried out, there was no ozone smell around the charging device of the example 5 as shown in FIG. 34. An example 6 of the invention relates to a charging device similar to that of the twenty-fifth embodiment. When an experiment similar to the example 1 was carried out, there was no ozone smell around the charging device of the example 6 as shown in FIG. 34.

An example 7 of the invention relates to a charging device similar to that of the twenty-seventh embodiment. When an experiment similar to the example 1 was carried out, there was no ozone smell around the charging device of the example 7 as shown in FIG. 34. An example 8 of the invention relates to a charging device similar to that of the twenty-ninth embodiment. When an experiment similar to the example 1 was performed, there was no ozone smell around the charging device of the example 8 as shown in FIG. 34.

Figure 33:
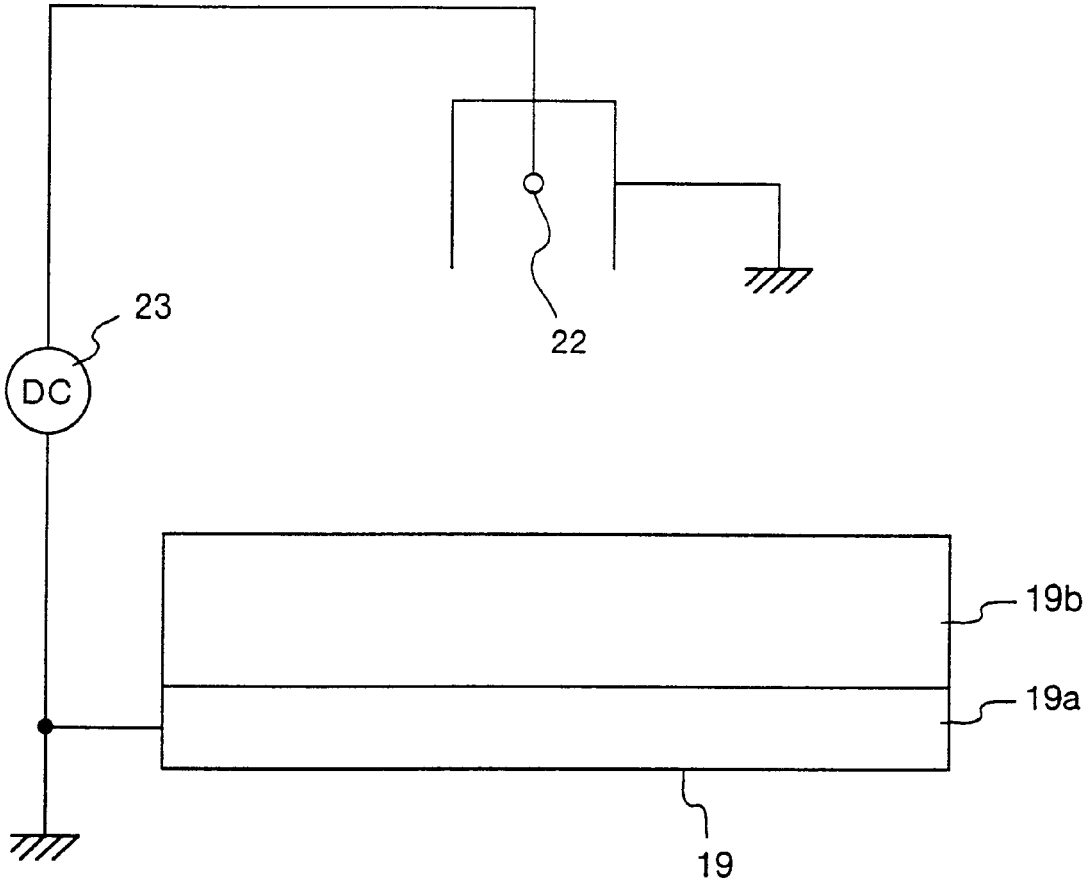
FIG. 33 is a cross section of a comparison example 1.

FIG. 33 shows comparison example 1. The comparison example 1 relates to a charging device using a conventional corona wire 22. A DC power source 23 is connected between the corona wire 22 and the substrate 19*a* of the photosensitive body 19. When an experiment similar to the example 1 was conducted, there was ozone smell around the charging device of the comparison example 1.

According to one aspect of the present invention, by using the configurations, the following effects are obtained. Ozone generated and diffused and NOx can be reduced and the size of the device can be reduced. The surface of a body can be uniformly charged and deterioration in an image caused by the charging device can be prevented.

Further, the larger amount of charges can be discharged. The charging of a charged body can be highly and stably controlled.

Further, the construction of an electrode can be also simplified. A fine adjustment by, for embodiment, controlling an application voltage to each of the electrodes can be performed. Even if a failure such as disconnection in any of the electrodes occurs, discharge can be maintained by the remaining electrodes.

Further, even when paper powders, toner particles and the like on the charged body are partially adhered to an electrode, charging by the electrode is helped by the neighboring electrode Consequently, charging unevenness is suppressed.

Further, since the paper powders and toner particles on the charged body are not easily adhered, the charging can be stably controlled. Since the path of air current is assured, the descent of the relatively heavy ozone molecules and oxygen exchange are facilitated, so that discharge is stabilized.

Further, a larger amount of ozone resides in the space sandwiched by the walls and decomposition of ozone is promoted.

Further, a larger amount of ozone resides in the space sandwiched and decomposition of ozone is promoted.

Further, by concentration of an electric line of force on the tips of the teeth of the electrodes, the efficiency of discharge increases so that charging is performed with a relatively low voltage.

According to another aspect of the present invention, generated ions and the like are captured in the space between the substrates and do not escape so that the density of ozone increases. Consequently, decomposition of ozone is promoted and the density of ozone exhausted is lowered.

Further, the charging amount of the charged body can be arbitrarily controlled. The electrode can efficiently ejects only charges of a necessary polarity among charges generated by the discharge toward the body to be charged.

Further, the electrode can efficiently ejects only charges of a necessary polarity among charges generated by the discharge toward the body to be charged. Also, handling and, especially, maintenance at the time of cleaning is facilitated.

According to still another aspect of the present invention, the area where the electric field intensity is high is formed, discharge occurs with a low voltage, and the ozone generating amount is reduced.

According to still another aspect of the present invention, the area where the electric field intensity is high is formed, discharge occurs with a low voltage, and the ozone generating amount is reduced.

Further, the area where the electric field intensity is high is formed, discharge occurs with a low voltage, and the ozone generating amount is reduced.

Further, with the above structure, the area where the electric field intensity is high is formed, discharge occurs with a low voltage, and the ozone generating amount is reduced. In addition, it is possible to improve uniformity of charging and to perform more uniform charging, as compared with the above aspect.

Further, with the above structure, the area where the electric field intensity is high is formed, discharge occurs with a low voltage, and the ozone generating amount is reduced. Also, uniformity of charging can be maintained.

Further, the discharge area becomes wider and charge can be performed more uniformly.

According to still another aspect of the present invention, the area where the electric field intensity is high is formed, discharge occurs with a low voltage, and the ozone generating amount is reduced.

Further, the area where the electric field intensity is high is formed, discharge occurs with a low voltage, and the ozone generating amount is reduced.

Further, the area where the electric field intensity is high is formed, discharge occurs with a low voltage, and the ozone generating amount is reduced.

Further, the area where the electric field intensity is high is formed, discharge occurs with a low voltage, and the ozone generating amount is reduced.

The discharge area becomes wider and charge can be performed more uniformly.

Further, a desired charge potential can be certainly obtained.

According to still another aspect of the present invention, an electrophotographic apparatus which produces a small amount of ozone exhaust can be realized without using an ozone filter.

The present document incorporates by reference the entire contents of Japanese priority document, 11-190356 filed in Japan on Jul. 5, 1999 and 11-197531 filed in Japan on Jul. 12, 1999.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A charging device which charges a body, said device comprising:

at least a pair of linear electrodes which are close to each other and provided on a substrate; and a wall having a height larger than a line width of said linear electrode, said wall being provided near the linear electrode, wherein the linear electrodes are surrounded by said walls and said substrate.

2. The charging device according to claim 1, wherein the longitudinal direction of each of said linear electrodes is parallel to an axial direction of said body.

3. The charging device according to claim 1, wherein the longitudinal direction of each of said linear electrodes is parallel to a moving direction of said body.

4. The charging device according to claim 1, wherein a plurality of pairs of said linear electrodes are arranged so that a longitudinal direction of each of said linear electrodes is oblique with respect to a moving direction of said body.

5. The charging device according to claim 1, wherein said substrate is arranged perpendicular to a moving direction of said body.

6. The charging device according to claim 5, wherein said wall is formed so as to extend from said substrate in a direction perpendicular to an axial direction of said body.

7. The charging device according to claim 5, wherein said pair of linear electrodes are arranged so that their electrode faces are opposite to each other.

8. The charging device according to claim 1, wherein tips of said linear electrodes have a saw-tooth shape.

9. The charging device according to claim 1, further comprising:

a bias electrode arranged on a charged side of said body, which generates a bias electric field between said bias electrode and said body.

10. The charging device according to claim 9, wherein said bias electrode is integrally formed with the body of said charging device.

11. A charging device comprising:

a first electrode formed on a first substrate; and a second electrode which is formed on a second substrate and faces said first electrode over an insulating wall, wherein discharge occurs by applying an AC voltage across said first and second electrodes.

12. The charging device according to claim 11, further comprising:

a bias electrode arranged on a side of a body to be charged, which generates a bias electric field between said bias electrode and said body.

13. The charging device according to claim 12, wherein said bias electrode is integrally formed with the body of said charging device.

14. A charging device having a space as an ion generating area, comprising:

a plurality of dielectrics disposed along a first direction facing a drum; and a plurality of electrodes disposed along said first direction, wherein said plurality of dielectrics sandwich said plurality of electrodes along a second direction perpendicular to said first direction, wherein said dielectrics have a height larger than a height of said electrodes along said first direction, and wherein at least two neighboring electrodes have different shapes.

15. The charging device according to claim 14, wherein electrodes which are bilaterally symmetrical are lined.

16. The charging device according to claim 14, wherein three or more electrodes are lined.

17. The charging device according to claim 14, further comprising a grid electrode between said ion generating area and a said drum.

18. A charging device having a space as an ion generating part defined between dielectrics sandwiching electrodes, comprising an electrode forming a predetermined angle with a face of each of said dielectrics sandwiching the electrode; and a grid electrode between said ion generating part and a body.

19. The charging device according to claim 18, wherein electrodes which are bilaterally symmetrical are lined.

20. The charging device according to claim 18, wherein electrodes of a same shape are lined.

21. The charging device according to claim 20, wherein a central part in cross section of said electrode is recessed.

22. The charging device according to claim 18, wherein three or more electrodes are lined.

23. The charging device according to claim 22, wherein neighboring electrodes have a step in an ion ejecting direction, three or more electrodes are lined, and an electrode sandwiched by electrodes via dielectrics is recessed in the ion ejecting direction from said electrodes on both sides.

24. The charging device according to claim 19, wherein neighboring symmetrical electrodes are paired, each of said pair of electrodes is sandwiched by dielectrics, and said pair of electrodes are recessed in an ion ejecting direction from said electrodes on both sides of entire of the dielectrics and said pair of electrodes.

25. The charging device according to claim 24, wherein said electrodes on both sides are closed to said pair of electrodes.

26. The charging device according to claim 24, wherein two or more sets each having said dielectrics, on both sides of entire of said dielectrics and said pair of electrodes are lined.

27. A charging device having a space as an ion generating area defined between dielectrics sandwiching electrodes, wherein neighboring electrodes have a step in an ion ejecting direction, three or more electrodes are lined, and an electrode sandwiched by electrodes via dielectrics is recessed in the ion ejecting direction from said electrodes on both sides.

28. The charging device according to claim 27, further comprising a grid electrode between said ion generating area and a body.

29. An electrophotographic apparatus comprising:

a charging device having a space as an ion generating area;

a plurality of dielectrics disposed along a first direction facing a drum; and a plurality of electrodes disposed along said first direction, wherein said plurality of dielectrics sandwich said plurality of electrodes along a second direction perpendicular to said first direction, wherein said dielectrics have a height larger than a height of said electrodes along said first direction, and wherein at least two neighboring electrodes have different shapes.

30. An electrophotographic apparatus comprising:

a charging device which has a space as an ion generating part defined between dielectrics sandwiching electrodes, and comprises an electrode forming a predetermined angle with a face of each of said dielectrics sandwiching the electrode; and a grid electrode between said ion generating part and a body.

31. An electrophotographic apparatus comprising:

a charging device which has a space as an ion generating area defined between dielectrics sandwiching electrodes, wherein neighboring electrodes have a step in an ion ejecting direction, three or more electrodes are lined, and an electrode sandwiched by electrodes via dielectrics is recessed in the ion ejecting direction from said electrodes on both sides.

32. A charging device comprising:

an electrically insulating substrate;

a first dielectric wall disposed on and extending from a surface of said electrically insulating substrate;

a second dielectric wall disposed on and extending from said surface of said electrically insulating substrate, said first and second dielectric walls defining a region on said surface between said first and second dielectric walls;

a plurality of ion emission electrodes disposed on said surface of said electrically insulating substrate; and one of the plurality of ion emission electrodes being disposed on said electrically insulating substrate in said region between the first and second dielectric walls and configured to emit ions upon application of a voltage across said one of said plurality of ion emission electrodes and an adjacent ion emission electrode disposed outside said region between the first and second dielectric walls.

33. The charging device according to claim 32, further comprising:

plural additional dielectric walls disposed on and extending from said surface of said electrically insulating substrate and defining plural regions on which respective of said ion emission electrodes is disposed; and plural of said ion emission electrodes being short circuited to each other and not short circuited to plural others of said ion emission electrodes, and said plural others of said ion emission electrodes being short circuited to each other, whereby plural adjacent pairs of said ion emission electrodes emit ions upon application of a voltage across the plural adjacent pairs of ion emission electrodes.

34. The charging device according to claim 32, further comprising:

means for applying an AC voltage between said one of the plurality of electrodes and another of said adjacent ones of the plurality of electrodes to generate ions in a space defined by the first and second dielectric walls and said one of the plurality of electrodes.

35. The charging device according to claim 34, wherein said means for applying an AC voltage is a plurality of terminals respectively connected between each of the plurality of electrodes and an AC voltage source.

36. The charging device according to claim 32 wherein said means for applying an AC voltage is a plurality of terminals respectively connected between each of the plurality of electrodes and an AC voltage source.

37. The charging device according to claim 32, wherein a wall height of said first and second dielectric walls is greater than a line width of said one of the plurality of electrodes disposed between the first and second dielectric walls.

38. The charging device according to claim 32, further comprising:

a body separated by a gap from ends of the first and second dielectric walls.

39. The charging device according to claim 38, further comprising: terminals configured to connect a DC voltage bias supply between the body and the plurality of electrodes.

* * * * *